US008936167B2

(12) United States Patent
Ishihara et al.

(10) Patent No.: US 8,936,167 B2
(45) Date of Patent: Jan. 20, 2015

(54) CRANE

(75) Inventors: Hideaki Ishihara, Akashi (JP); Shintaro Sasai, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 210 days.

(21) Appl. No.: 13/325,388

(22) Filed: Dec. 14, 2011

(65) Prior Publication Data

US 2012/0152878 A1 Jun. 21, 2012

(30) Foreign Application Priority Data

Dec. 17, 2010 (JP) ..... 2010-281156
Dec. 20, 2010 (JP) ..... 2010-282534

(51) Int. Cl.

| | |
|---|---|
| ***B66C 23/26*** | (2006.01) |
| ***B66C 23/82*** | (2006.01) |
| ***B66C 23/88*** | (2006.01) |
| ***B66C 23/36*** | (2006.01) |

(52) U.S. Cl.

CPC ..... *B66C 23/365* (2013.01); *B66C 23/82* (2013.01); *B66C 23/88* (2013.01)
USPC ..... 212/180; 212/239

(58) Field of Classification Search

CPC ..... B66C 15/06; B66C 15/065; B66C 23/26; B66C 23/34; B66C 23/344; B66C 23/346; B66C 23/82; B66C 25/00; B66C 23/88
USPC ..... 212/280, 276, 179–181, 294, 223, 232, 212/237, 239, 255, 260, 261, 271, 175; 340/685
See application file for complete search history.

(56) References Cited

U.S. PATENT DOCUMENTS 6,695,158 B2 * 2/2004 Taylor et al. ..... 212/298

FOREIGN PATENT DOCUMENTS

| | | |
|---|---|---|
| JP | 2006-315844 | 11/2006 |
| JP | 2007-290789 | 11/2007 |
| JP | 2008143626 A * | 6/2008 |

* cited by examiner

*Primary Examiner* — Sang Kim
*Assistant Examiner* — Juan Campos, Jr.
(74) *Attorney, Agent, or Firm* — Oblon, Spivak, McClelland, Maier & Neustadt, L.L.P.

(57) ABSTRACT

A crane includes a limiting device to limit a raising/lowering angle of the mast during suspending work to be equal to or less than an upper limit angle which is less than a value of the raising/lowering angle when the mast extends vertically; a release device into which a release instruction for causing the limiting device to release the limitation on the raising/lowering angle of the mast is input; and a first detection section adapted to detect that the mast support device is at an overhanging position where the mast support device pushes up and sets the mast in the work posture. The limiting device is operable whenever the first detection section does not detect that the mast support device is at the overhanging position, even if the release instruction is input into the release device, to prohibit the mast from being tilted rearward beyond the upper limit angle.

6 Claims, 14 Drawing Sheets

CRANE

BACKGROUND OF THE INVENTION

1. Field of the Invention

The present invention relates to a crane having a configuration for preventing a mast from collapsing due to operator's operational mistake.

2. Background Art

Heretofore, as a crane such as a crawler crane, there has been known a mast-type crane as disclosed, for example, in JP 2007-290789A. In the mast-type crane, with respect to a front end of a frame of an upper slewing body slewably mounted on a lower propelling body, a base end of a boom is coupled in such a manner as to be pivotable around the front end of the frame, and a base end of a mast for supporting the boom at a high position via a guy line is also coupled in such a manner as to be pivotable around the front end of the frame. Two spreaders are provided, respectively, on a tip end of the mast and on the side of the frame, and a raising and lowering rope is wound around and between the two spreaders. The frame is provided with a raising and lowering winch which is adapted to wind or unwind the raising and lowering rope to allow the boom and the mast to be tilted so as to be raised or lowered.

This type of crane is also equipped with a mast support device (also called, a mast push-up mechanism or a mast raising mechanism) provided on the upper slewing body to push up the mast from a transportation posture where the mast extends approximately horizontally, to a work posture where the mast extends obliquely in such a manner as to become gradually higher toward the tip end thereof. Further, this type of crane is adapted to be capable of performing assembling and disassembling thereof by its own ability, through a suspending work using the mast as substitute for the boom, during the assembling and disassembling of the crane. During the suspending work using the mast, a raising/lowering angle of the mast is limited to a predetermined range by an overload preventing device, in the same manner as that during a normal suspending work, and the mast support device is typically returned to a storage position where it is lowered rearwardly, so as not to hinder the suspending work using the mast. Thus, when the mast is returned from the work posture to the transportation posture after completion of the suspending work using the mast, it is necessary to perform operation in the following sequence:

(1) Moving the mast support device to an overhanging position;

(2) Manually operating a release device, such as a release switch, for releasing the limitation on the raising/lowering angle of the mast by the overload preventing device;

(3) Winding the raising and lowering rope by the raising and lowering winch to tilt the mast to a position where the mast is inclined rearwardly with respect to a vertical state thereof (a state in which the mast raising/lowering angle is 90 degrees), while being supported by the mast support device; and (4) Returning the mast support device from the overhanging position to the storage position, while supporting the mast, to thereby return the mast to the transportation posture.

However, when an operator actually returns the mast from the work posture to the transportation posture after completion of the suspending work using the mast, the operator is likely to perform the operation in a different sequence from that described above. In particular, despite the fact that the mast support device is not at the overhanging position, an operator is likely to operate the release device, such as a release switch, without ascertaining the fact, and then operates the raising and lowering winch to wind the raising and lowering rope so as to swingingly move the mast to a position where the mast is inclined rearwardly with respect to the vertical state. This operational mistake gives rise to a problem that the mast falls down rearwardly by its own weight, and resulting shock causes damages to the mast and devices on the upper slewing body.

SUMMARY OF THE INVENTION

It is an object of the present invention to make it possible to prevent collapse of the mast due to the above operational mistake to ensure safety.

According to one aspect of the present invention, there is provided a crane which comprises: an upper slewing body having a frame; a boom having a tip end, and a base end supported by a front end of the frame in such a manner as to be pivotable therearound, the boom being adapted to be raised and lowered according to the pivoting movement of the base end thereof; a mast having a tip end coupled to the tip end of the boom via a guy line, and a base end supported by the front end of the frame in such a manner as to be pivotable therearound, wherein the mast is adapted to be raised and lowered according to the pivoting movement of the base end thereof; an upper spreader provided on the tip end of the mast; a lower spreader disposed rearwardly with respect to a position at which the upper spreader is disposed when the mast is in a raised state; a raising and lowering rope wound around and between the upper spreader and the lower spreader; a raising and lowering winch adapted to wind or unwind the raising and lowering rope to allow the boom and the mast to be tilted so as to be raised or lowered; a mast support device provided on the upper slewing body to push up the mast to change a posture of the mast from a transportation posture where the mast is lowered rearwardly to extend approximately horizontally, to a work posture where the mast extends forwardly and obliquely upwardly; a limiting device adapted, during a suspending work for suspending a load from the tip end of the mast, to limit a raising/lowering angle of the mast to be equal to or less than an upper limit angle which is less than a value of the raising/lowering angle as measured when the mast extends vertically; a release device into which a release instruction for causing the limiting device to release the limitation on the raising/lowering angle of the mast is input; and a first detection section adapted to detect that the mast support device is at an overhanging position where the mast support device pushes up and set the mast in the work posture, wherein the limiting device is operable, whenever the first detection section does not detect that the mast support device is at the overhanging position, even if the release instruction is input into the release device, to prohibit the mast from being tilted rearward beyond the upper limit angle.

DETAILED DESCRIPTION OF THE EMBODIMENTS OF THE INVENTION

An embodiment of the present invention as a mode for carrying out the present invention will now be described in accordance with the drawings.

(First Embodiment)

Figure 1:
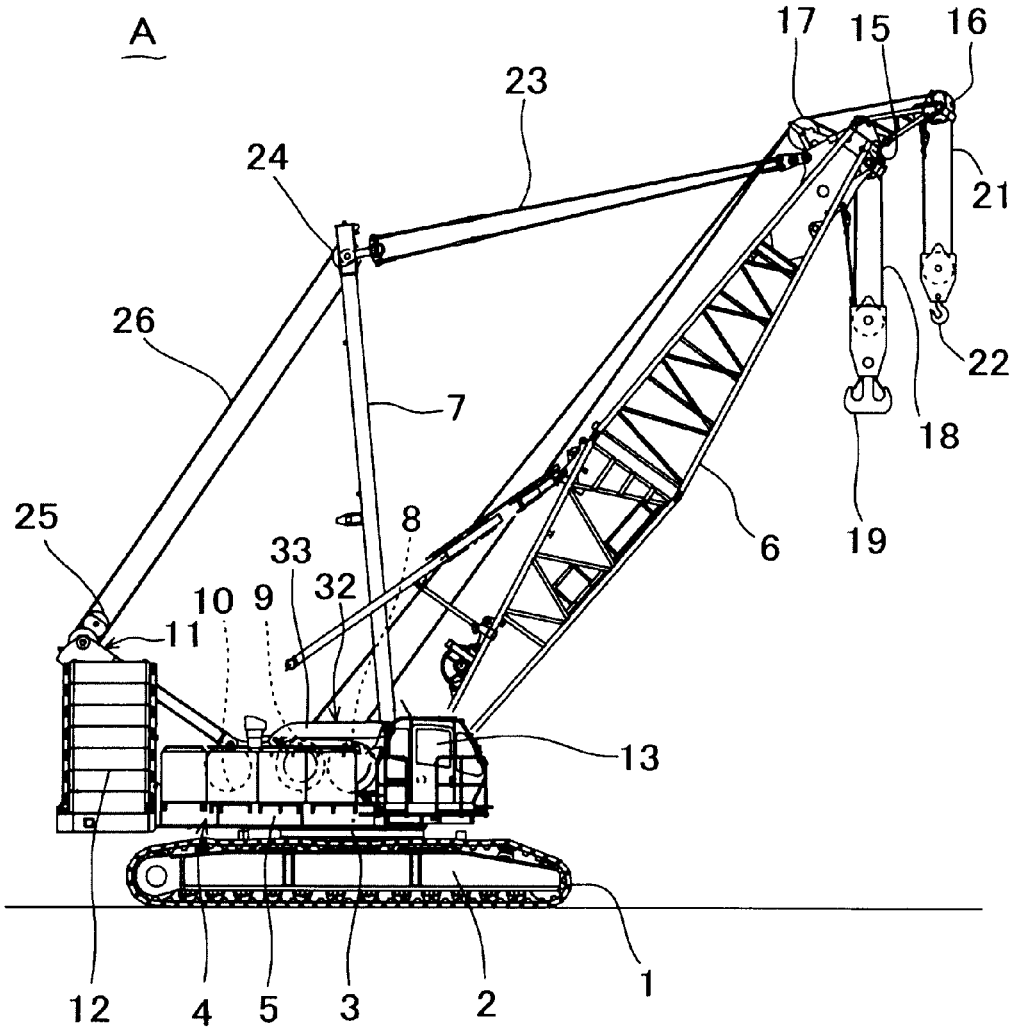
FIG. 1 is a side view illustrating a mast-equipped crawler crane according to a first embodiment of the present invention, during a normal suspending work.

FIG. 1 illustrates a general configuration of a mast-equipped crawler crane A according to a first embodiment of the present invention. The crawler crane A comprises a lower propelling body 2 adapted to travel by using a crawler 1, and an upper slewing body 4 slewably mounted on the lower propelling body 2 through a turning device 3. The crawler crane A further comprises a boom 6, a mast 7, a plurality of winches 8, 9, 10, a gantry 11, a guy line 23, an upper spreader 24, a lower spreader 25, a raising and lowering rope 26, a mast support device 32, a safety system 40, and a release switch 41.

The upper slewing body 4 has a frame 5. The boom 6 has a base end supported by a front end of the frame 5 in such a manner as to be pivotable therearound, and a tip end which is an end on the other side of the base end. The mast 7 has a base end supported by the front end of the frame 5 in such a manner as to be pivotable therearound, and a tip end which is an end on the other side of the base end. The base end of each of the boom 6 and the mast 7 is supported by the frame 5 in such a manner as to be pivotable therearound, which means that each of the boom 6 and the mast 7 is adapted to be raisable and lowerable. The plurality of (in the illustrated embodiment, three) winches 8, 9, 10 are arranged in a central region of the frame 5 of the upper slewing body 4 in a line in a forward-rearward direction. Each of the gantry 11 and a counterweight 12 is mounted on a rear portion of the frame 5 of the upper slewing body 4. The gantry 11 is provided on the frame 5 in such a manner as to be raisable and lowerable at a position rearward of the mast 7. The gantry 11 is raised and lowered by an unillustrated hydraulic cylinder provided in the upper slewing body 4. Further, a cab 13 is provided at a position on a lateral side of a coupling portion of the upper slewing body 4 between the frame 5 and each of the base end of the boom 6 and the base end of the mast 7.

The tip end of the boom 6 is provided with a boom point sheave 15, an auxiliary sheave 16 and an idler sheave 17. A main hook 19 is hung down from the boom point sheave 15 via a main hoist rope 18. An auxiliary hook 22 is hung down from the auxiliary sheave 16 via an auxiliary hoist rope 21. The main hoist rope 18 is arranged to extend to, for example, the first winch 8 on the frame 5, through the idler sheave 17, and one end of the main hoist rope 18 is wound around the first winch 8. The main hook 19 is hoisted up or hoisted down by the first winch 8. On the other hand, the auxiliary hoist rope 21 is arranged to extend to the second winch 9 on the frame 5 through the idler sheave 17, and one end of the auxiliary hoist rope 21 is wound around the second winch 9. The auxiliary hook 22 is hoisted up or hoisted down by the second winch 9.

The tip end of the boom 6 and the tip end of the mast 7 are coupled together via the guy line 23. The upper spreader 24 is provided on the tip end of the mast 7. The lower spreader 25 is provided on a portion of the gantry 11 which becomes a top of the gantry 11 when the gantry 11 is set in a work posture where it is raised. The lower spreader 25 is disposed at a position rearward of the upper spreader 24 and closer to frame 5 than the upper spreader 24. The raising and lowering rope 26 is wound around and between the upper and lower spreaders 24, 25. One end of the raising and lowering rope 26 is wound around the third winch 10 on the frame 5 as a raising and lowering winch. The raising and lowering winch 10 is adapted to wind or unwind the raising and lowering rope 26 to allow the boom 6 and the mast 7 to be tilted so as to be raised or lowered.

The cab 13 is internally provided with a non-illustrated first manipulation device for instructing the winch 8 to perform hoisting-up and hoisting-down of the main hook 19, a non-illustrated second manipulation device for instructing the winch 9 to perform hoisting-up and hoisting-down of the auxiliary hook 22, and a non-illustrated third manipulation device for instructing the raising and lowering winch 10 to perform hoisting-up and hoisting-down of the mast 7. Each of the first to third manipulation devices comprises a control lever capable of being manually operated from a neutral position thereof toward one of opposite sides, i.e., a hoisting-up side and a hoisting-down side. Specifically, when the control lever of a selected one of the first to third manipulation devices is operated from the neutral position toward the hoisting-up side, one of the winches corresponding to the selected manipulation device performs the hoisting-up. On the other hand, when the control lever of a selected one of the first to third manipulation devices is operated from the neutral position toward the hoisting-down side, one of the winches corresponding to the selected manipulation device performs the hoisting-down.

More specifically, each of the winches 8, 9, 10 comprises a non-illustrated hydraulic motor. When each of the hydraulic motors is activated, a corresponding one of the winches 8, 9, 10 is activated to perform the hoisting-up and hoisting-down. The crane is equipped with a hydraulic pump for supplying pressure oil. This hydraulic pump is connected to each of the hydraulic motors of the winches 8, 9, 10. Each of the hydraulic motors of the winches 8, 9, 10 is supplied with pressure oil from the hydraulic pump via a hydraulic circuit, and activated according to the supply of pressure oil. The hydraulic circuit is provided with a first control valve for controlling the supply of pressure oil from the hydraulic pump to the hydraulic motor of the winch 8, a second control valve for controlling the supply of pressure oil from the hydraulic pump to the hydraulic motor of the winch 9, and a third control valve for controlling the supply of pressure oil from the hydraulic pump to the hydraulic motor of the winch 10. Each of the first to third control valves has a hoisting-up pilot port and a hoisting-down pilot port. The hoisting-up pilot port and the hoisting-down pilot port of each of the first to third control valves for controlling the supply of pressure oil to respective ones of the hydraulic motors of the winches 8, 9, 10 are connected to a corresponding one of the manipulation devices for the winches 8, 9, 10, via an individual pilot pressure circuit. When the control lever of the manipulation device for a target one of the winches 8, 9, 10 is manually operated, a pilot pressure depending on the manual operation of control lever is supplied to an associated one of the pilot ports of a corresponding one of the control valves from the manipulation device via a corresponding one of the pilot pressure circuits. On the other hand, under a condition that the control lever of the manipulation device for a target one of the winches 8, 9, 10 is not operated (i.e., is at the neutral position), no pilot pressure is supplied to any of the pilot ports of a corresponding one of the control valves from the manipulation device. Then, when the control lever is operated from the neutral position toward the hoisting-up side, the manipulation device starts supplying a pilot pressure to the hoisting-up pilot port of the corresponding control valve. In response to the pilot pressure, the control valve starts supplying pressure oil, which is supplied from the hydraulic pump, to the hydraulic motor of the target winch to allow the target winch to perform the hoisting-up. Differently, when the control lever is operated from the neutral position toward the hoisting-down side, the manipulation device starts supplying a pilot pressure to the hoisting-down pilot port of the corresponding control valve. In response to the pilot pressure, the control valve starts supplying pressure oil, which is supplied from the hydraulic pump, to the hydraulic motor of the target winch to allow the target winch to perform the hoisting-down.

The crawler crane A is equipped with an overload preventing device (not illustrated) for imposing a limitation on cargo (load) to be suspended by the main hook 19 or the auxiliary hook 22, and a limitation on raising/lowering angle of the boom 6, during a normal suspending work illustrated in FIG. 1. As used in this specification, the term "normal suspending work" means a work for suspending a load by the hook 19 or 22 hung down from the tip end of the boom 6. The crawler crane A is transported in a state after a part of the crawler crane A is disassembled therefrom in advance of the transportation. FIGS. 2 to 5 illustrate an assembling process for changing the crawler crane A from a partially-disassembled state during the transportation to an assembled state during the normal suspending work.

Figure 2:
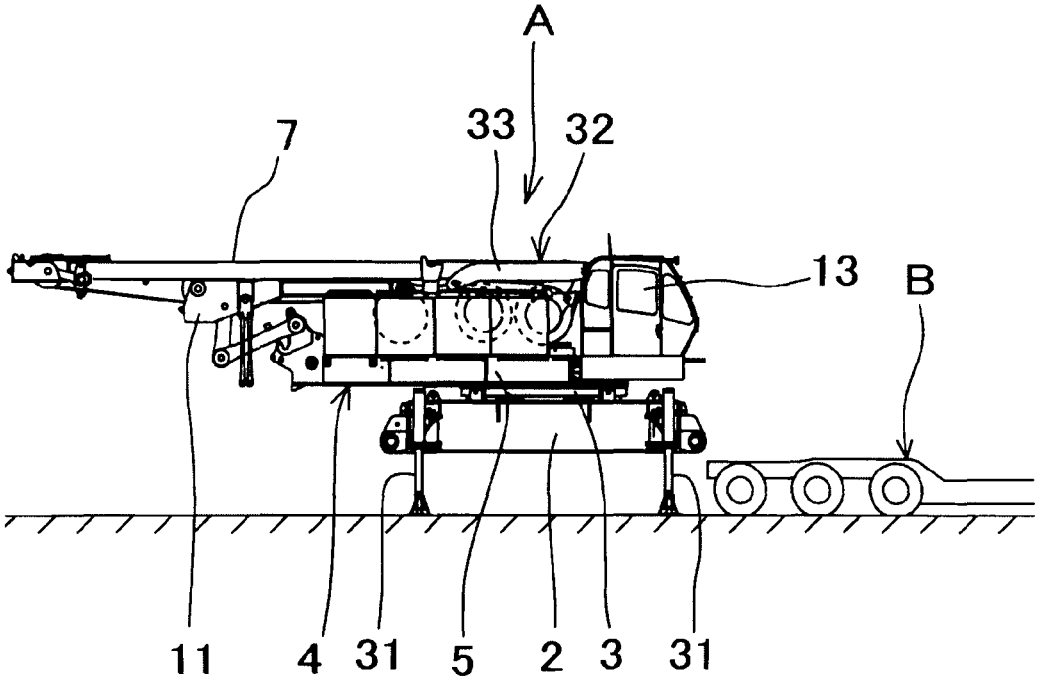
FIG. 2 is a side view illustrating the crawler crane in a state just after the crawler crane illustrated in FIG. 1 is disassembled and then transported.

Specifically, FIG. 2 illustrates a state of the crawler crane A just after transportation using a trailer B. In advance of transportation of the crawler crane A, a part of the components thereof, such as the crawler 1, the boom 6 and the counterweight 12, are detached from the crawler crane A, and each of the mast 7 and the gantry 11 is lowered rearwardly and stored. Just after the transportation of the crawler crane A, the crawler crane A is lifted by a jack 31 provided in the lower propelling body 2, and the trailer B is pulled outside the crawler crane A.

Figure 3:
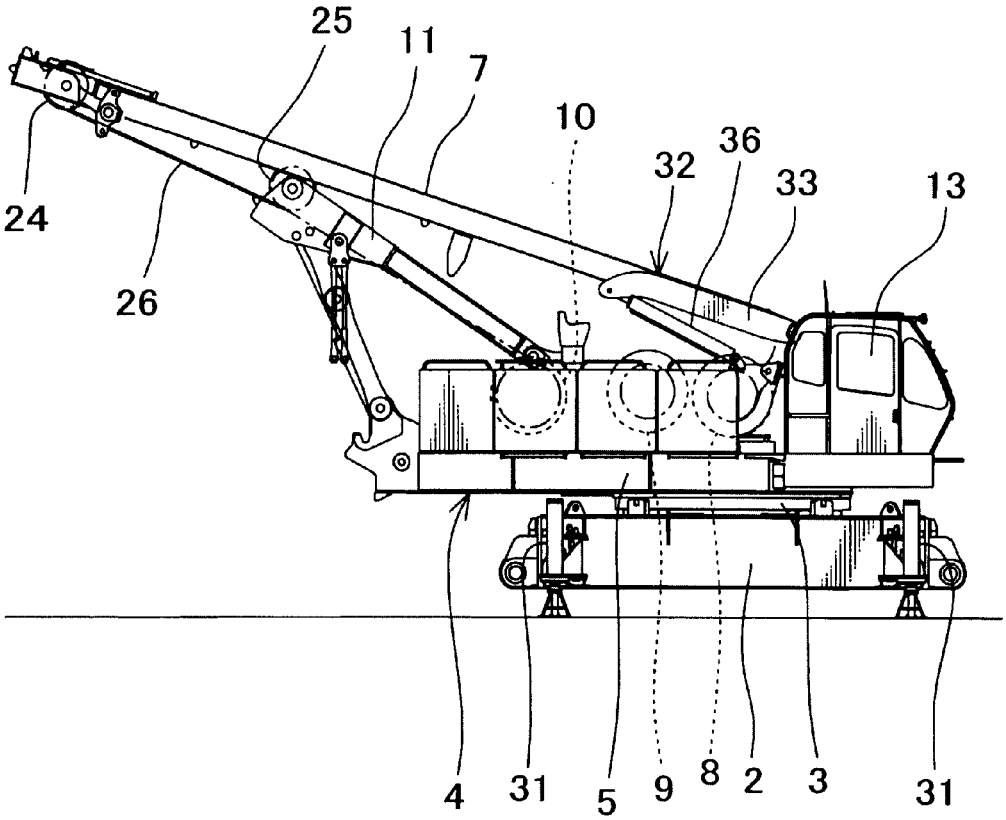
FIG. 3 is a side view illustrating a state when a mast is being raised after lowering a jack, in the crawler crane in the state illustrated in FIG. 2.

Then, as illustrated in FIG. 3, the jack 31 is shortened to lower the crawler crane A, and then the gantry 11 is raised. Subsequently, the raising and lowering rope 26 is unwound from the raising and lowering winch 10, while pushing up the mast 7 to allow the mast 7 to be tilted so as to pivot around a coupling shaft coupling the frame 5 and the base end of the mast 7 together, in a direction causing the mast 7 to be raised. As a result, the mast 7 is set in a work posture illustrated in FIG. 4. The crawler crane A is equipped with a mast support device 32 provided on the upper slewing body 4 to push up the mast 7 to change a posture of the mast 7 from a transportation posture to the work posture. The transportation posture of the mast 7 is a posture where the mast 7 is lowered rearwardly to extend approximately horizontally. The work posture of the mast 7 is a posture where the mast 7 extends forwardly and obliquely upwardly. In other words, the work posture of the mast 7 is a posture where the mast 7 extends forwardly in such a manner as to become gradually higher toward the tip end thereof. The mast support device 32 is adapted to be interposed between the mast 7 and the frame 5 to support the mast 7 from a side rearward thereof so as not to fall down rearwardly.

Figure 6:
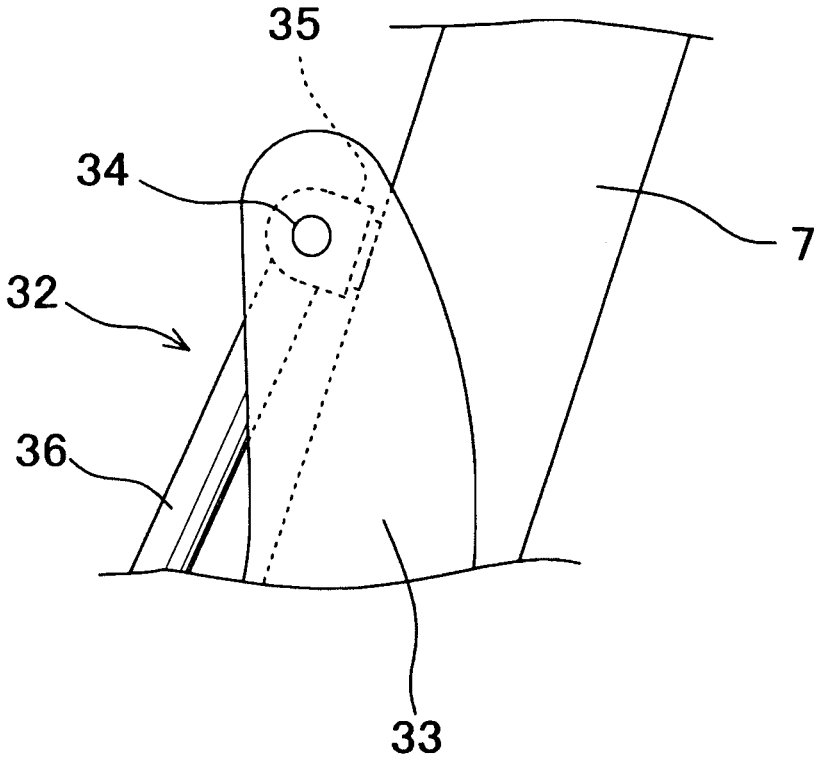
FIG. 6 is an enlarged view illustrating the area VI in FIG. 4.

The mast support device 32 comprises a pair of right and left link members 33 (only one of the link members is illustrated), a sliding member 35 specifically illustrated in FIG. 6, and a cylinder 36. The pair of right and left link members 33 are arranged to extend along the mast 7 while sandwiching a base end portion of the mast 7 therebetween. Further, one end of each of the link members 33 is concentrically coupled to the coupling shaft coupling the frame 5 and the base end of the mast 7 together, in such a manner as to be relatively pivotable with respect to the coupling shaft. The sliding member 35 is installed between the other ends of the pair of link members 33 through a coupling shaft 34. The sliding member 35 contacts a rear surface of the mast 7 in such a manner as to be slidingly movable with respect to the rear surface of the mast 7. The cylinder 36 has one end coupled to the frame 5 at a position rearward of the coupling shaft provided in the base end of the mast 7, and the other end coupled to the sliding member 35. In the mast support device 32, the sliding member 35 is adapted, according to an extending and retracting movement of the cylinder 36, to move the mast 7 so that the mast 7 pivots around the coupling shaft of the frame 5 and the base end of the mast 7 so as to raise and lower the mast 7, while being slidingly moved with respect to the rear surface of the mast 7.

Figure 4:
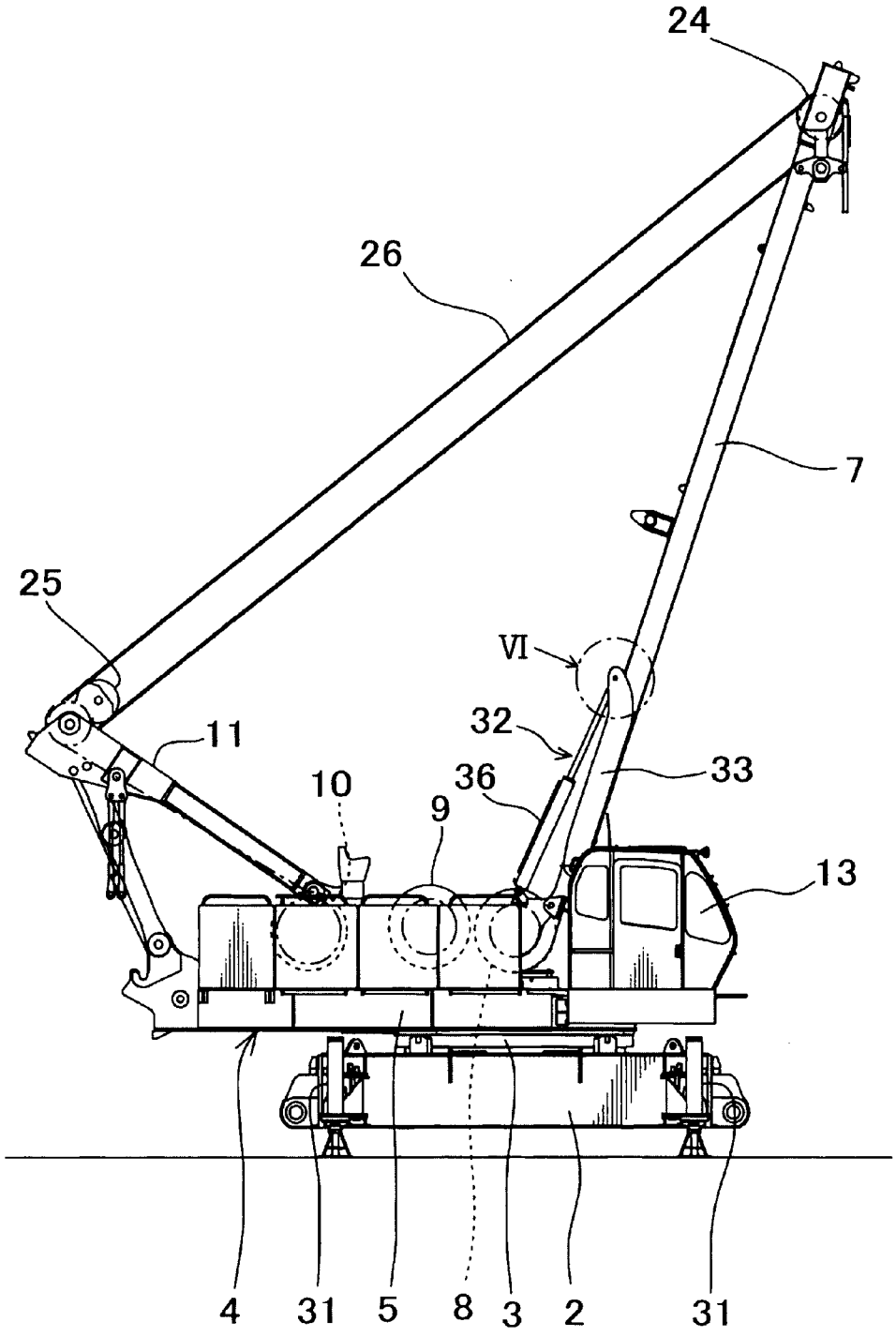
FIG. 4 is a side view illustrating a state when the disassembled crawler crane is performing a suspending work using the mast.
Figure 5:
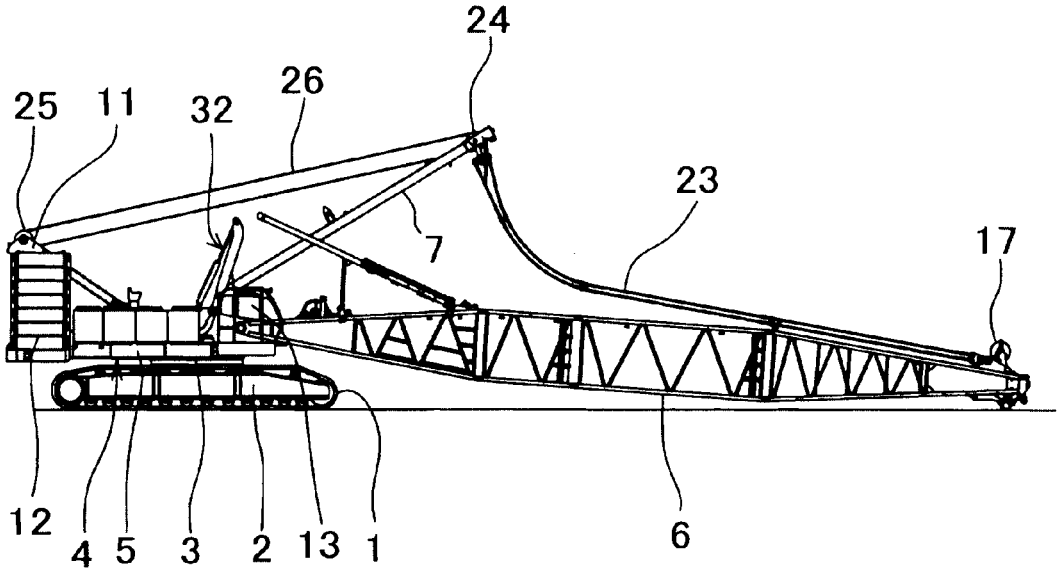
FIG. 5 is a side view illustrating a state just after completion of assembling of the crawler crane.

In the crawler crane A, after the mast 7 is set in the work posture illustrated in FIG. 4, a suspending hook (not illustrated) is hung down from the tip end of the mast 7. Then, the crawler crane A performs a suspending work using the suspending hook, i.e., a suspending work for suspending a load from the tip end of the mast 7 (hereinafter referred to as "suspending work using the mast 7"). Through the suspending work using the mast 7, the crawler crane A can attach the components, such as the crawler 1, the boom 6 and the counterweight 12, by its own ability without using a different crane, to establish an assembled state as illustrated in FIG. 5.

In a process for changing the crawler crane A from the assembled state during the normal suspending work to the partially-disassembled state during the transportation, the boom 6 is lowered forwardly until the boom 6 is brought into contact with the ground, and then an inverse process with respect to the aforementioned assembling process is performed. In a suspending work using the mast 7 to be performed during the above process, a part of the components, such as the crawler 1, the boom 6 and the counterweight 12, are detached.

In the suspending work using the mast 7 to be performed during assembling and disassembling of the crawler crane A by its own ability, it is necessary to impose a limitation on cargo (load) to be suspended, and a limitation on raising/lowering angle of the mast 7, in the same manner as that during the normal suspending work. For this reason, in addition to the aforementioned overload preventing device for use in the normal suspending work, the crawler crane A is equipped with an aftermentioned controller 43 serving as an overload preventing device for use in the suspending work using the mast 7. The controller 43 serves as a limiting device adapted to limit the raising/lowering angle of the mast 7 to a predetermined angular range during the suspending work using the mast 7 to be performed during assembling and disassembling of the crawler crane A by its own ability. Specifically, the controller 43 is operable, during the suspending work using the mast 7, to limit the raising/lowering angle of the mast 7 to be equal to or less than an upper limit angle which is less than a value of the raising/lowering angle as measured when the mast 7 extends vertically. The raising/lowering angle of the mast 7 means a smaller angle out of the angles of the mast 7 with respect to a horizontal plane, in the case where the mast 7 extends upwardly with respect to the horizontal plane (a plane orthogonal to the vertical direction) and is lowered forwardly with respect to a posture of the mast 7 extending vertically; and means a larger angle out of the angles of the mast 7 with respect to the horizontal plane, in the case where the mast 7 extends upwardly with respect to the horizontal plane and is lowered rearwardly with respect to a posture of the mast 7 extending vertically. Further, in the case where the mast 7 is lowered forwardly in such a manner as to extend downwardly with respect to the horizontal plane, the raising/lowering angle of the mast 7 has a negative value. In this case, the raising/lowering angle of the mast 7 means an angle whose absolute value is smaller out of the angles of the mast 7 with respect to the horizontal plane.

Figure 8:
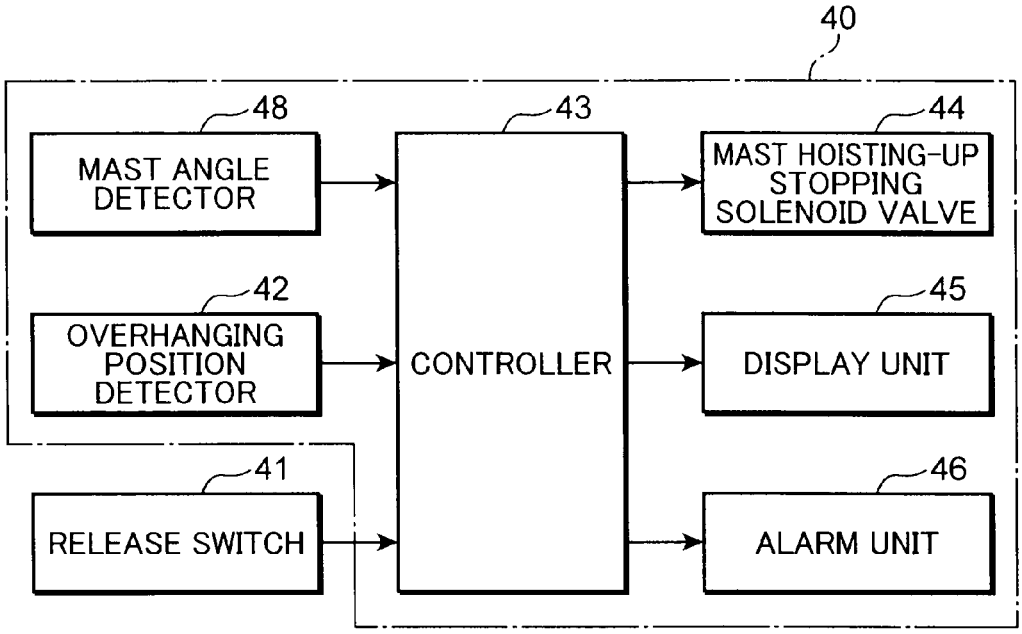
FIG. 8 is a block diagram illustrating a mast-collapse preventing device in the crawler crane according to the first embodiment.

The crawler crane A is also equipped with a release switch 41 (see FIG. 8) provided inside the cab 13. The release switch 41 is configured to be input a release instruction thereinto. The release instruction is designed to cause the controller 43 to release the limitation on the raising/lowering angle of the mast 7. The release switch 41 serves as a release device for enabling the mast 7 to be tilted rearward so as to cause a change in posture of the mast 7 from the work posture to the transportation posture. More specifically, the release switch 41 comprises a non-illustrated switch body and a non-illustrated operating member. The operating member is adapted to be operated by an operator, and provided in the switch body in such a manner as to be movable between an ON position and an OFF position. The release instruction to be input into the release switch 41 corresponds to a manual operation for moving the operating member from the OFF position to the ON position. When the operating member is moved to the ON position, the switch body outputs a release signal to the controller 43, and, when the operating member is set at the OFF position, the switch body avoids outputting the release signal to the controller 43.

During the normal suspending work and the suspending work using the mast 7, the mast support device 32 is lowered rearwardly and stored (see FIG. 1) so as not to hinder the suspending work. Thus, in cases where an operator intends to operate the operating member of the release switch 41 to the ON position and return the mast 7 from the work posture to the transportation posture after the suspending work using the mast 7, it is necessary for the operator to perform an operational sequence comprising the steps of: ascertaining whether the mast support device 32 is at an overhanging position where the mast support device 32 pushes up the mast 7 in such a manner that the posture of the mast 7 is changed to the work posture; if the mast support device 32 is not at the overhanging position, moving the mast support device 32 to the overhanging position; then operating the operating member of the release switch 41 to the ON position so as to return the mast 7 from the work posture to the transportation posture. However, if the operator mistakes the operational sequence, i.e., operates the operating member of the release switch 41 to the ON position under the condition that the mast support device 32 is not at the overhanging position, an accident of collapse of the mast 7 is likely to occur.

Therefore, as one feature of the first embodiment, the safety system 40 (see FIG. 8) is operable to prevent the collapse of the mast 7. The safety system 40 comprises an overhanging position detector 42, the controller 43, a mast hoisting-up stopping solenoid valve 44, a display unit 45, an alarm unit 46, and a mast angle detector 48.

The overhanging position detector 42 serves as a detection section (first detection section) adapted to detect that the mast support device 32 is at the overhanging position.

The controller 43 is operable, in response to receiving a signal from the overhanging position detector 42, etc., to stop or permit the tilting movement of the mast 7 when a predetermined condition is satisfied.

The mast hoisting-up stopping solenoid valve 44 is adapted, according to a command from the controller 43, to stop the tilting movement of the mast 7 by the raising and lowering winch 10 (stop the hoisting-up by the raising and lowering winch 10). Specifically, the mast hoisting-up stopping solenoid valve 44 is provided in the pilot pressure circuit fluidly communicating between the manipulation device for the raising and lowering winch 10 and the hoisting-up pilot port of the control valve for controlling the supply of pressure oil to the hydraulic motor of the raising and lowering winch 10. The solenoid valve 44 is adapted, when the controller 43 permits the tilting movement of the mast 7, i.e., when a command (signal) for giving an instruction for stopping the tilting movement of the mast 7 is not sent from the controller 43 thereto, to be set to an ON state for permitting a pilot pressure to be supplied from the manipulation device for the raising and lowering winch 10, to the hoisting-up pilot port of the control valve fluidly communicated with the manipulation device for the raising and lowering winch 10. In this case, when the control lever of the manipulation device for the raising and lowering winch 10 is operated toward the hoisting-up side, the hoisting-up of the mast 7 by the raising and lowering winch 10, i.e., the tilting movement of the mast 7 in a hoisting-up direction, is permitted. Further, the solenoid valve 44 is adapted, when the controller 43 prohibits the tilting movement of the mast 7, i.e., when the command (signal) for giving an instruction for stopping the tilting movement of the mast 7 is sent from the controller 43 thereto, to be set to an OFF state for blocking the supply of the pilot pressure from the manipulation device for the raising and lowering winch 10, to the hoisting-up pilot port of the control valve fluidly communicated with the manipulation device for the raising and lowering winch 10. In this case, even if the control lever of the manipulation device for the raising and lowering winch 10 is operated toward the hoisting-up side, the hoisting-up of the mast 7 by the raising and lowering winch 10, i.e., the tilting movement of the mast 7 in the hoisting-up direction, is prohibited. The mast hoisting-up stopping solenoid valve 44 is configured to, when it is in the OFF state, bring out the function of stopping the tilting movement of the mast 7, which is intended to ensure a fail-safe function.

The display unit 45 and the alarm unit 46 serve as an informing section adapted, according to a command from the controller 43, to inform an operator about a situation where the mast support device 32 is not at the overhanging position although the release switch 41 is operated to be turned on. The mast angle detector 48 is designed to detect the raising/lowering angle of the mast 7.

The mast angle detector 48 is adapted to output a detection signal indicative of a detected value of raising/lowering angle of the mast 7 to the controller 43.

Figure 7:
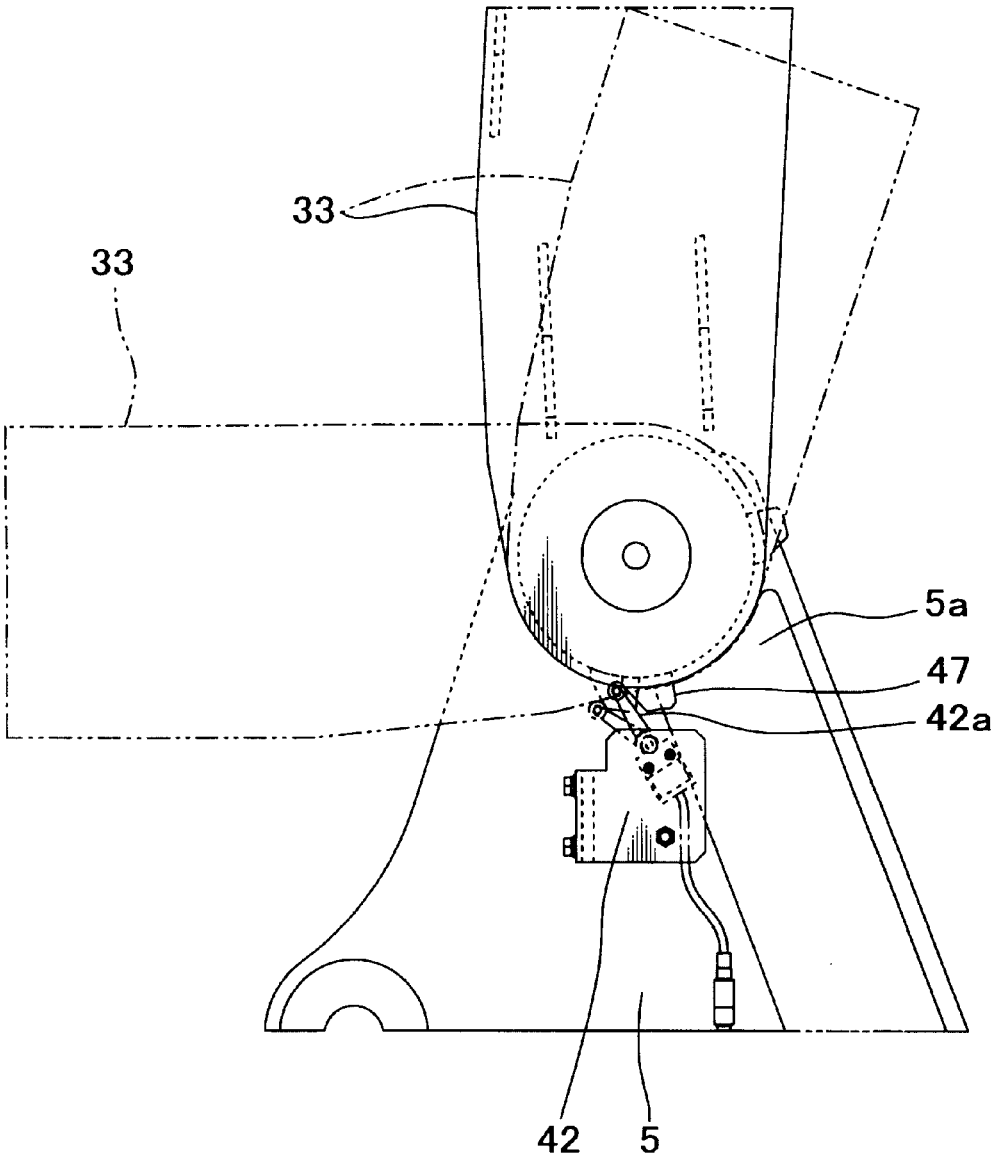
FIG. 7 is a side view illustrating an installation state of an overhanging-position detector.

As illustrated in FIG. 7, the overhanging position detector 42 is installed on a mast support portion 5*a* of the frame 5 in opposed relation to a base end of one of the link members 33 of the mast support device 32. The overhanging position detector 42 is adapted, when the link member 33 of the mast support device 32 is moved to the overhanging position from the storage position though the vertical position, to detect the fact and output a detection signal to the controller 43. Specifically, the overhanging position detector 42 outputs a detection signal in response to a contact between a contact lever 42*a* of the overhanging position detector 42 and a protrusion 47 provided on the base end of the link member 33, when the link member 33 is moved to the overhanging position. As used here, the term "overhanging position" means a position of the mast support device 32 where it is tilted forward from the vertical position by a predetermined angle, and the term "storage position" means a position of the mast support device 32 where it is lowered rearwardly.

The controller 43 is operable, if the overhanging position detector 42 does not detect that the mast support device 32 is at the overhanging position (no detection signal is sent from the overhanging position detector 42 to the controller 43), at a time when the operating member of the release switch 41 is operated from the OFF position to the ON position, to prohibit the mast 7 from being tilted rearward beyond the upper limit angle. Further, the controller 43 is operable, if the overhanging position detector 42 detects that the mast support device 32 is at the overhanging position (a detection signal is sent from the overhanging position detector 42 to the controller 43), at a time when the operating member of the release switch 41 is operated from the OFF position to the ON position, to permit the mast 7 to be tilted rearward beyond the upper limit angle. In the first embodiment, when the controller 43 prohibits the mast 7 from being tilted rearward, the prohibition of the rearward tilting movement of the mast 7 is achieved by prohibiting the raising and lowering winch 10 from hoisting up the mast 7. Further, when the controller 43 permits the mast 7 to be tilted rearward, the permission of the rearward tilting movement of the mast 7 is achieved by permitting the raising and lowering winch 10 to hoist up the mast 7. The controller 43 has various functions other than the above control function of stopping or permitting the tilting movement of the mast 7 based on the detection signal from the overhanging position detector 42. Specifically, the controller 43 has: a part of the function of the overload preventing device for the suspending work using the mast 7, i.e., a part of a function of imposing a limitation on the raising/lowering angle of the mast 7 based on a detection signal from the mast angle detector 48 adapted to detect the raising/lowering angle of the mast 7; and a function of when the operating member of the release switch 41 is operated to the ON position, releasing the limitation on the raising/lowering angle of the mast 7 during the suspending work using the mast 7. Among various controls by the controller 43, a control during a process of lowering the mast 7 rearwardly from the work posture during the suspending work using the mast 7 and storing the mast 7, is performed according to the flowchart illustrated in FIG. 9.

Figure 9:
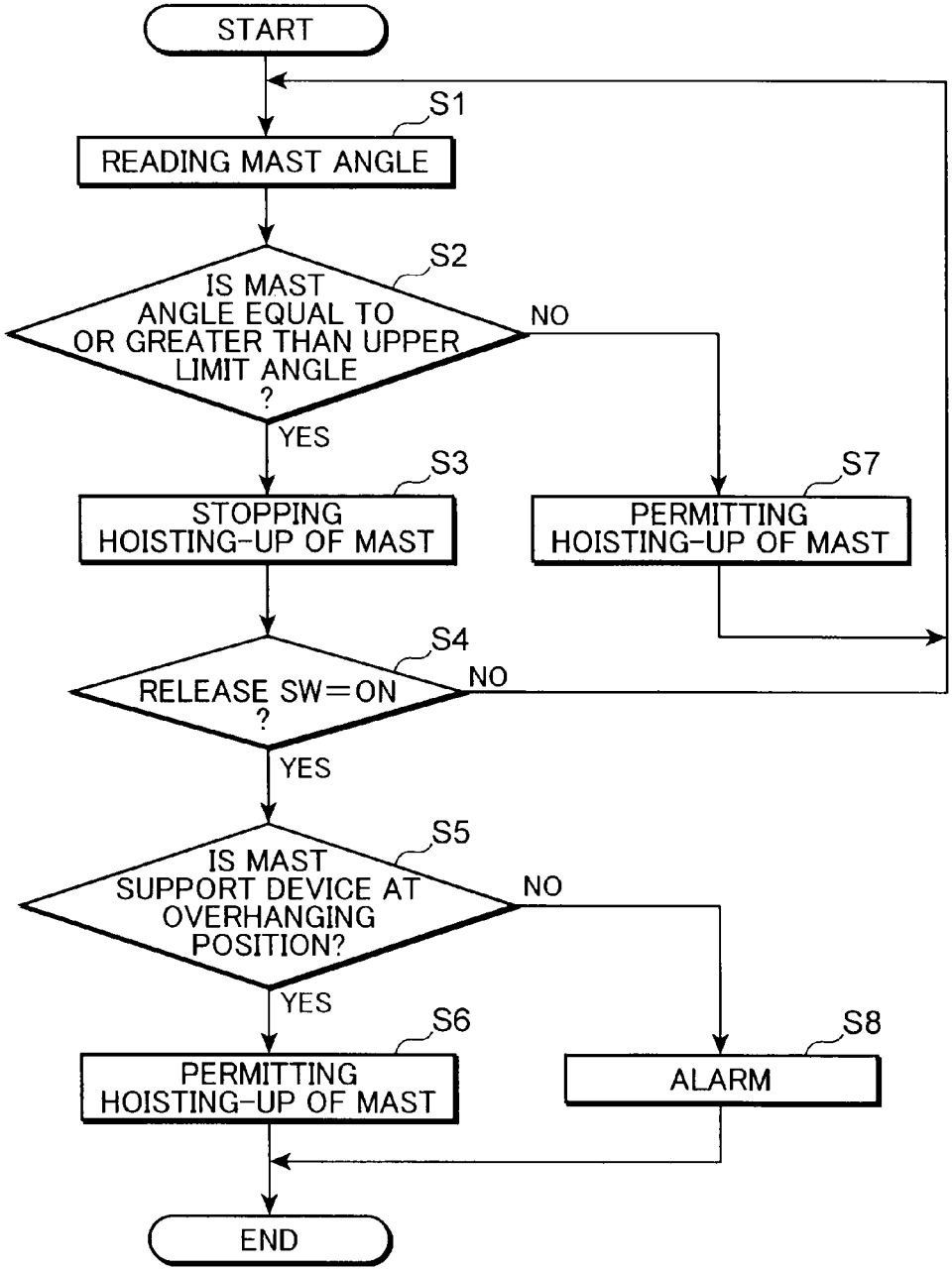
FIG. 9 is a flowchart illustrating details of control to be executed by a controller of the mast-collapse preventing device in the crawler crane according to the first embodiment.

Specifically, in FIG. 9, after the control is started, the controller 43 reads a value of the raising/lowering angle of the mast 7 (mast angle) from a detection signal which is sent from the mast angle detector 48 (Step S1), and determines whether the read mast angle is equal to or greater than the upper limit angle of the mast 7 during the suspending work using the mast 7 (Step S2). When the determination is made as NO, i.e., the mast angle is less than the upper limit angle, the controller 43 sets the mast hoisting-up stopping solenoid valve 44 to the ON state to thereby permit the raising and lowering winch 10 to hoist up the mast 7 (specifically, permit the mast 7 to be tilted in the hoisting-up direction) (Step S7). Subsequently, the controller 43 returns to Step S1 to continue the process. On the other hand, when the determination in Step S2 is made as YES, i.e., the mast angle is equal to or greater than the upper limit angle, the controller 43 sets the mast hoisting-up stopping solenoid valve 44 to an OFF state to thereby stop the hoisting-up of the mast 7 by the raising and lowering winch 10 (Step S3).

Subsequently, in Step S4, the controller 43 determines whether the release instruction for causing the controller 43 to release the limitation on the raising/lowering angle of the mast 7 during the suspending work using the mast 7 is input into the release switch 41, i.e., the release switch 41 is operated to be turned on. More specifically, based on whether the release signal is output from the switch body of the release switch 41, the controller 43 determines whether the operating member of the release switch 41 is operated from the OFF position to the ON position. When the release signal is output from the switch body, the controller 43 determines that the operating member of the release switch 41 is operated to the ON position. When the release signal is not output from the switch body, the controller 43 determines that the operating member of the release switch 41 is not operated to the ON position. When the determination in Step S4 by the controller 43 is made as NO, i.e., the controller 43 determines that the operating member of the release switch 41 is not operated from the OFF position to the ON position (no release instruction is input into the release switch 41), the controller 43 returns to Step S1 to continue the process. On the other hand, when the determination in Step S4 is made as YES, i.e., the controller 43 determines that the operating member of the release switch 41 is operated from the OFF position to the ON position (the release instruction is input into the release switch 41), the controller 43 further determines, based on a signal from the overhanging position detector 42, whether the mast support device 32 is at the overhanging position (Step S5). When the determination in Step S5 is made as YES, the controller 43 turns on the mast hoisting-up stopping solenoid valve 44 to thereby permit the raising and lowering winch 10 to hoist up the mast 7 (Step S6). Then, the controller 43 terminates the control process. On the other hand, when the determination in Step S5 is made as NO, the controller 43 causes the display unit 45 and the alarm unit 46 to inform an operator about a situation where the mast support device 32 is not at the overhanging position although the release switch 41 is operated to be turned on (the release instruction is input into the release switch 41) (Step S8). Specifically, the controller 43 causes the display unit 45 to display, on a screen thereof, alarm message and/or image for informing an operator about a situation where the mast support device 32 is not at the overhanging position although the release switch 41 is operated to be turned on, and causes the alarm unit 46 to generate alarm sound for informing the operator about the situation. Then, the controller 43 terminates the control process.

Functions and effects of the safety system 40 in the crane according to the first embodiment will be described below. If an operator performs an operation of returning the mast 7 from the work posture to the transportation posture after completion of the suspending work using the mast 7, according a proper sequence comprising: moving the mast support device 32 to the overhanging position; and then operating the operating member of the release switch 41 to the ON position, the controller 43 determines that the release switch 41 is operated to be turned on and the mast support device 32 is at the overhanging position, and then permits the hoisting-up of the mast 7, i.e., the tilting movement of the mast 7 in the hoisting-up direction (Step S6 in FIG. 9). In this case, the mast 7 is tilted to a position where it is inclined rearwardly with respect to the vertical state, while being supported by the mast support device 32.

On the other hand, in the process of returning the mast 7 from the work posture to the transportation posture after completion of the suspending work using the mast 7, if an operator operates, despite the fact that the mast support device 32 is not at the overhanging position, the operating member of the release switch 41 to the ON position without ascertaining the fact, the controller 43 determines, based on a signal from the overhanging position detector 42, that the mast support device 32 is not at the overhanging position, and thereby does not permit the hoisting-up of the mast 7. In this case, the raising/lowering angle of the mast 7 will never become equal to or grater than the upper limit angle during the suspending work using the mast 7. This makes it possible to prevent the occurrence of a situation where the mast 7 falls down rearwardly due to operator's operational mistake, and resulting shock causes damages to the mast 7 and devices on the upper slewing body 4, so that safety can be ensured.

As above, in the safety system 40, if, despite the fact that the mast support device 32 is not at the overhanging position, an operator manually turns on the release switch 41 without ascertaining the fact, the hoisting-up of the mast 7 is not permitted. In addition, based on display or indication of the display unit 45 and alarm sound from the alarm unit 46, the operator is informed about the situation where the release switch 41 is operated to be turned on although the mast support device 32 is not at the overhanging position. This allows the operator to readily recognize the situation where the mast 7 is not tilted, and therefore quickly take measures to deal with the situation.

It is understood that the present invention is not limited to the first embodiment, but various changes and modifications will be included in the scope of the present invention. For example, in the first embodiment, in addition to the function of stopping or permitting the tilting movement of the mast 7 based on a signal from the overhanging position detector 42, the controller 43 of the safety system 40 has: a part of the function of the overload preventing device for the suspending work using the mast 7, i.e., a part of a function of imposing a limitation on the raising/lowering angle of the mast 7 based on a detection signal from the mast angle detector 48 adapted to detect the raising/lowering angle of the mast 7; and a function of, when the release switch 41 is operated, releasing the limitation on the raising/lowering angle of the mast 7 during the suspending work using the mast 7. Alternatively, the controller 43 may be configured to perform only the control of stopping or permitting the tilting movement of the mast 7 based on a signal from the overhanging position detector 42, and other functions may be borne by a different control section. In this case, as a control section for performing only the control of stopping or permitting the tilting movement of the mast 7 based on a signal from the overhanging position detector 42, a relay circuit for on-off controlling the mast hoisting-up stopping solenoid valve 44, etc., may be used. In this modification, a device comprising the controller and the different control section corresponds to "limiting device" set forth in the appended claims.

In the first embodiment, the overhanging position detector 42 for detecting that the mast support device 32 is at the overhanging position is installed on the mast support portion 5*a* of the frame 5 in opposed relation to the base end of one of the link members 33 of the mast support device 32, wherein, when the link member 33 of the mast support device 32 is moved from the storage position to reach the overhanging position through the vertical position, the overhanging position detector 42 outputs a detection signal in response to a contact between the contact lever 42*a* and the protrusion 47 provided on the base end of the link member 33. However, the overhanging position detector in the present invention is not limited to such a configuration. For example, the overhanging position detector may be configured to detect an extending/retracting stroke of the cylinder 36 of the mast support device 32 and output a detection signal based on the detected extending/retracting stroke.

The first embodiment is one example in which the present invention is applied to the crawler crane A designed such that the gantry 11 is mounted on the rear portion of the frame 5 of the upper slewing body 4, and the raising and lowering rope 26 is wound around and between the lower spreader 25 provided on the top of the gantry 11 and the upper spreader 24 provided on the tip end of the mast 7. However, it is understood that the present invention may also be applied to a crawler crane designed such that a lower spreader is directly mounted to the rear portion of the frame 5 of the upper slewing body 4 without providing a gantry on the rear portion of the frame 5, and the raising and lowering rope 26 is wound around and between the lower spreader and the upper spreader 24 provided on the tip end of the mast 7.

(Second Embodiment)

A configuration of a crawler crane A according to a second embodiment of the present invention will be described below. The crawler crane A according to the second embodiment has a configuration unique to the second embodiment, in addition to the same configuration as that of the crane according to the first embodiment. Features and associated configurations of the crane A according to the second embodiment will be specifically described, although the following description includes a duplicated part of the description about the configuration of the crane according to the first embodiment.

Figure 10:
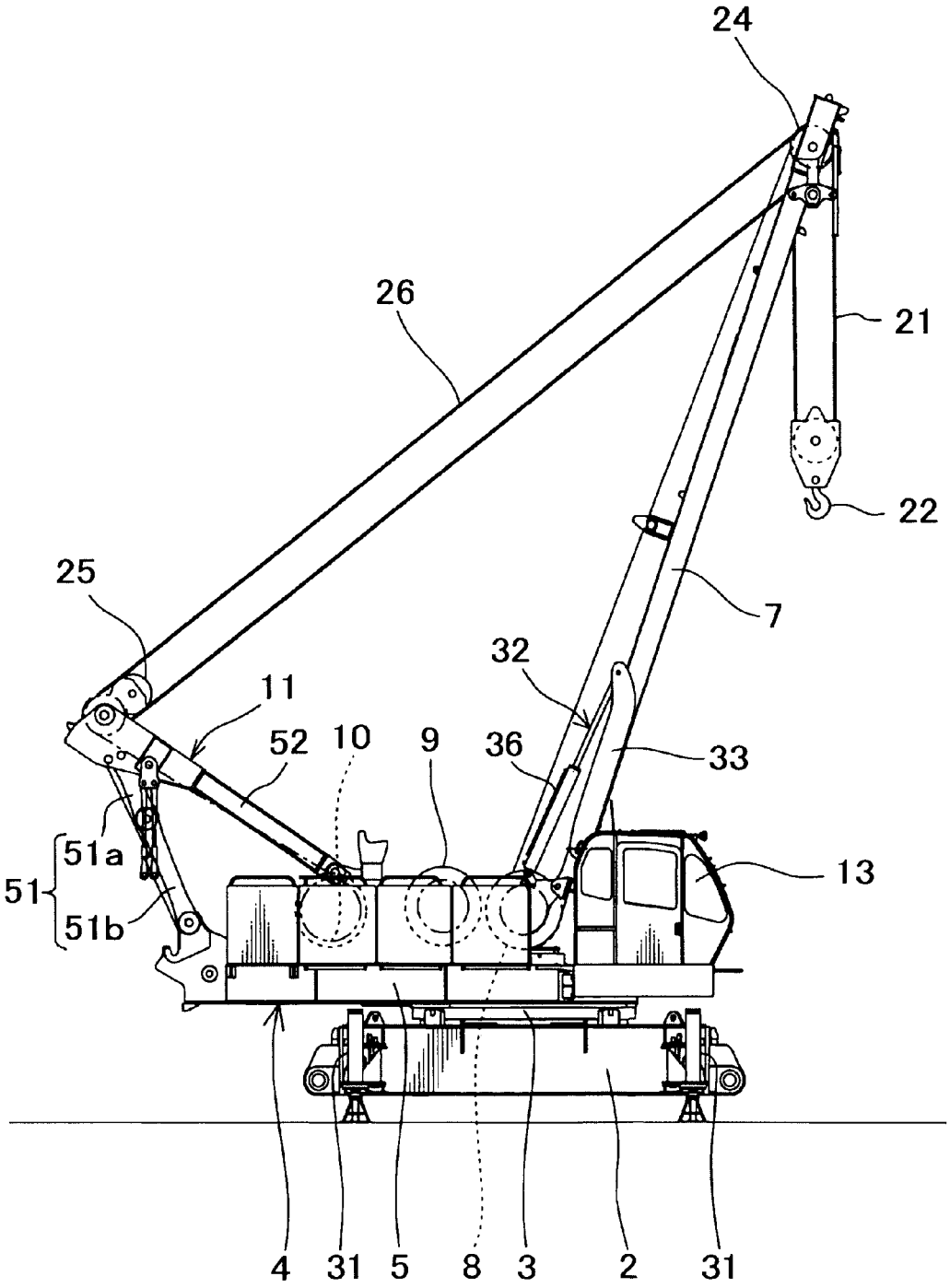
FIG. 10 is a side view illustrating a state when a mast-equipped crawler crane according to a second embodiment of the present invention, is performing the suspending work using the mast.

In the second embodiment, as illustrated in FIG. 10, a gantry 11 comprises a tension member 51 adapted to receive a tension of a raising and lowering rope 26 as a tensile force, and a compression member 52 adapted to receive a tension of the raising and lowering rope 26 as a compressive force. The tension member 51 is composed of two sub-members 51*a*, 51*b* coupled together in such a manner as to be foldable together. The gantry 11 is provided on a rear portion of a frame 5 of an upper slewing body 4 in such a manner that a posture thereof is changeable between a work posture where it is raised and a storage posture where it is lowered rearwardly. The gantry 11 is adapted to be set in the work posture during a suspending work using the crawler crane A, and set in the storage posture during transportation of the crawler crane A. In the work posture, each of the tension member 51 and the compression member 52 is kept in a raised state on the rear portion of the frame 5. In the storage posture, the tension member 51 and the compression member 52 are stored in such a manner that the two sub-members 51*a*, 51*b* of the tension member 51 are folded and lowered rearward, and then the compression member 52 is lowered rearwardly and superimposed thereon. A lower spreader 25 is provided on a portion of the gantry 11 which becomes a top of the gantry 11 when it is set in the work posture. When the gantry 11 is lowered rearwardly from the work posture, the portion of the gantry 11 which becomes a top of the gantry 11 when it is set in the work posture, is disposed at a position lower than that when the gantry 11 is in the work posture. The posture of the gantry 11 is changeable between the work posture and the storage posture by an unillustrated hydraulic cylinder provided in the upper slewing body 4. Specifically, the hydraulic cylinder has one end thereof connected to a tip end of the compression member 52 of the gantry 11, and has the other end thereof connected to a portion of the frame 5 located on a lower side of the compression member 52. The gantry 11 is allowed to be raised from the storage posture by expanding the hydraulic cylinder, and is allowed to be lowered rearwardly from the work posture by contracting the hydraulic cylinder.

During disassembling and assembling of the crawler crane A to be performed between transportation of the crawler crane A and a normal suspending work using the crawler crane A, a suspending work using a mast 7 as substitute for a boom (hereinafter referred to as "suspending work using the mast 7") is performed, as illustrated in FIG. 10. Specifically, the crawler crane A can perform a suspending work for suspending its own component as a load from a tip end of the mast 7, so as to perform assembling and disassembling thereof by its own ability. In the suspending work using the mast 7, it is necessary to impose a limitation on cargo (load) to be suspended, and a limitation on raising/lowering angle of the mast 7, in the same manner as that during the normal suspending work. For this reason, in the crawler crane A, a controller 43 (limiting device) of a safety system 40 serves as an overload preventing device for use in the suspending work using the mast 7 to limit the raising/lowering angle of the mast 7 to a predetermined angular range (e.g., of 30 to 80 degrees) during the suspending work using the mast 7. The controller 43 is operable, during the suspending work using the mast 7, to limit the raising/lowering angle of the mast 7 to be equal to or greater than a predetermined lower limit angle, as well as limiting the raising/lowering angle of the mast 7 to be equal to or less than the above upper limit angle.

Figure 11:
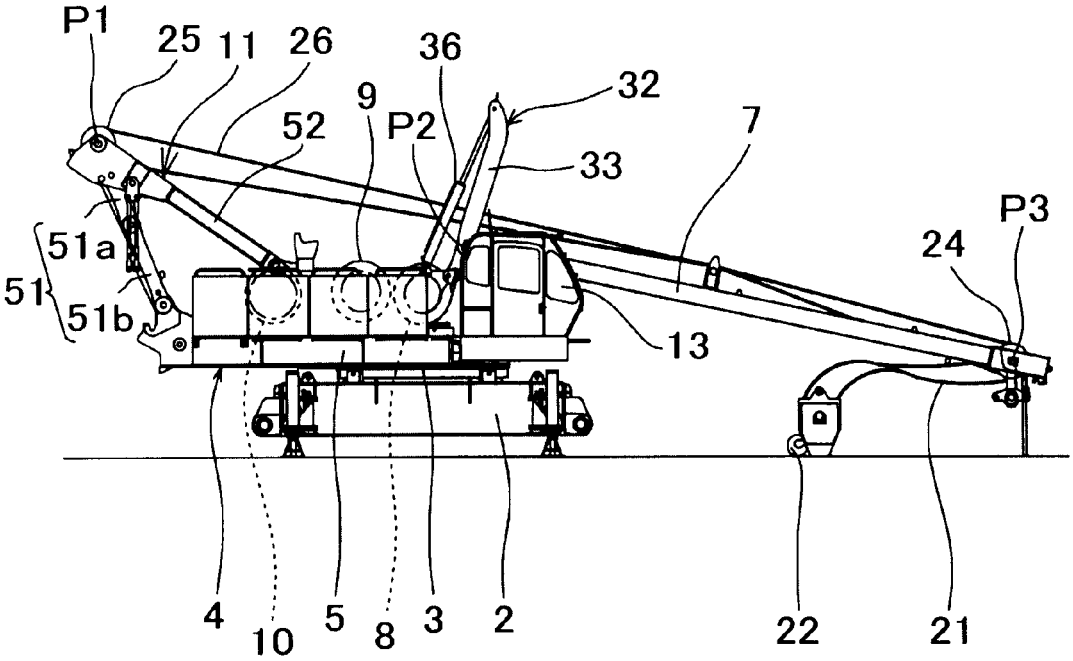
FIG. 11 is a side view illustrating a state after the mast is hoisted down to a position close to the ground, in the crawler crane according to the second embodiment.

In the crawler crane A according to the second embodiment, a release instruction to be input into a release switch 41 (see FIG. 13) is an instruction for causing the controller 43 to release the limitation on the raising/lowering angle of the mast 7 during the suspending work using the mast 7, i.e., a state in which the raising/lowering angle of the mast 7 during the suspending work using the mast 7 is limited to the upper limit angle or less and the lower limit angle or more. Specifically, when an operating member of the release switch 41 is operated from an OFF position to an ON position, a release instruction for causing the controller 43 to release the state in which the raising/lowering angle of the mast 7 during the suspending work using the mast 7 is limited to the upper limit angle or less and the lower limit angle or more, is input into the release switch 41. The operation of the operating member of the release switch 41 to the ON position is performed, for example, when a guy line is attached or detached to the tip end of the mast 7 after hoisting down the mast 7 to a position close to the ground as illustrated in FIG. 11, and when the mast 7 is returned to a transportation posture where the mast 7 is lowered rearwardly. A specific configuration of this release switch 41 is the same as that of the release switch 41 in the first embodiment.

Figure 13:
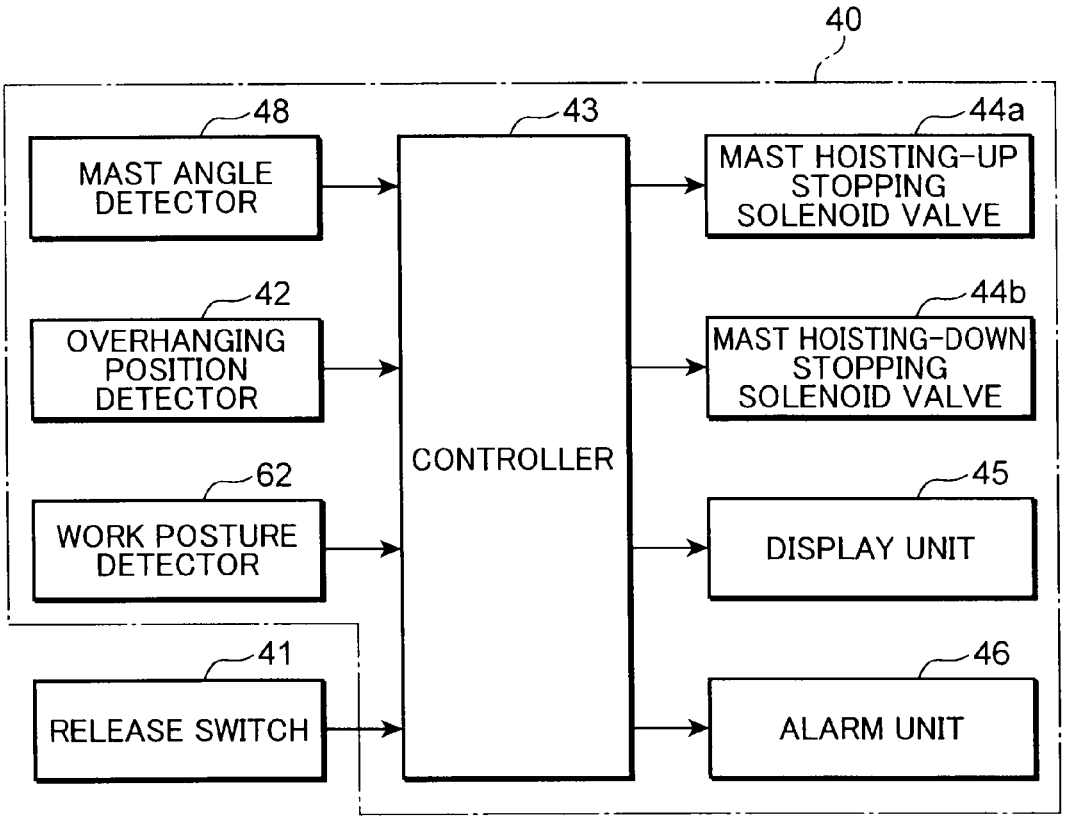
FIG. 13 is a block diagram illustrating a mast-collapse preventing device in the crawler crane according to the second embodiment.

In the second embodiment, as illustrated in FIG. 13, the safety system 40 comprises an overhanging position detector 42, the controller 43, a mast hoisting-up stopping solenoid valve 44*a*, a mast hoisting-down stopping solenoid valve 44*b*, a display unit 45, an alarm unit 46, a mast angle detector 48, and a work posture detector 62.

The work posture detector 62 serves as a detection section (second detection section) adapted to detect that the gantry 11 is in the work posture.

The controller 43 is operable, in response to receiving signals from the mast angle detector 48 and the work posture detector 62, etc., to stop or permit the tilting movement of the mast 7 (hoisting-up/hoisting-down of the mast 7 by the raising and lowering winch 10) when a predetermined condition is satisfied.

The mast hoisting-up stopping solenoid valve 44*a* is the same as the mast hoisting-up stopping solenoid valve 44 in the first embodiment.

The mast hoisting-down stopping solenoid valve 44*b* is adapted, according to a command from the controller 43, to stop the tilting movement of the mast 7 in a hoisting-down direction (stop hoisting-down by a raising and lowering winch 10). Specifically, the mast hoisting-down stopping solenoid valve 44*b* is provided in a pilot pressure circuit fluidly communicating between a manipulation device for the raising and lowering winch 10 and a hoisting-down pilot port of a control valve for controlling supply of pressure oil to a hydraulic motor of the raising and lowering winch 10. The solenoid valve 44*b* is adapted, when the controller 43 permits the tilting movement of the mast 7 in the hoisting-down direction, i.e., when a command (signal) for giving an instruction for stopping the tilting movement of the mast 7 in the hoisting-down direction is not sent from the controller 43 to the solenoid valve 44*b*, to be set to an ON state for permitting a pilot pressure to be supplied from the manipulation device for the raising and lowering winch 10, to the hoisting-down pilot port of the control valve fluidly communicated with the manipulation device for the raising and lowering winch 10. In this case, when a control lever of the manipulation device for the raising and lowering winch 10 is operated toward a hoisting-down side, the hoisting-down of the mast 7 by the raising and lowering winch 10, i.e., the tilting movement of the mast 7 in the hoisting-down direction, is permitted. Further, the solenoid valve 44*b* is adapted, when the controller 43 prohibits the tilting movement of the mast 7 in the hoisting-down direction, i.e., when a command (signal) for giving an instruction for stopping the tilting movement of the mast 7 in the hoisting-down direction is sent from the controller 43 to the solenoid valve 44*b*, to be set to an OFF state for blocking the supply of the pilot pressure from the manipulation device for the raising and lowering winch 10, to the hoisting-down pilot port of the control valve fluidly communicated with the manipulation device for the raising and lowering winch 10. In this case, even if the control lever of the manipulation device for the raising and lowering winch 10 is operated toward the hoisting-down side, the hoisting-down of the mast 7 by the raising and lowering winch 10, i.e., the tilting movement of the mast 7 in the hoisting-down direction, is prohibited. The mast hoisting-down stopping solenoid valve 44*b* is configured to, when it is in the OFF state, bring out the function of stopping the tilting movement of the mast 7, which is intended to ensure a fail-safe function, as with the mast hoisting-up stopping solenoid valve 44*a*.

The display unit 45 and the alarm unit 46 serve as an informing section adapted, according to a command from the controller 43, to inform an operator about a situation where the hoisting-up of the mast 7 is prohibited because the gantry 11 is not in the work posture, in cases where the work posture detector 62 does not detect that the gantry 11 is in the work posture at a time when the controller 43 stops the hoisting-up and hoisting-down of the mast 7 by the raising and lowering winch 10.

Figure 12:
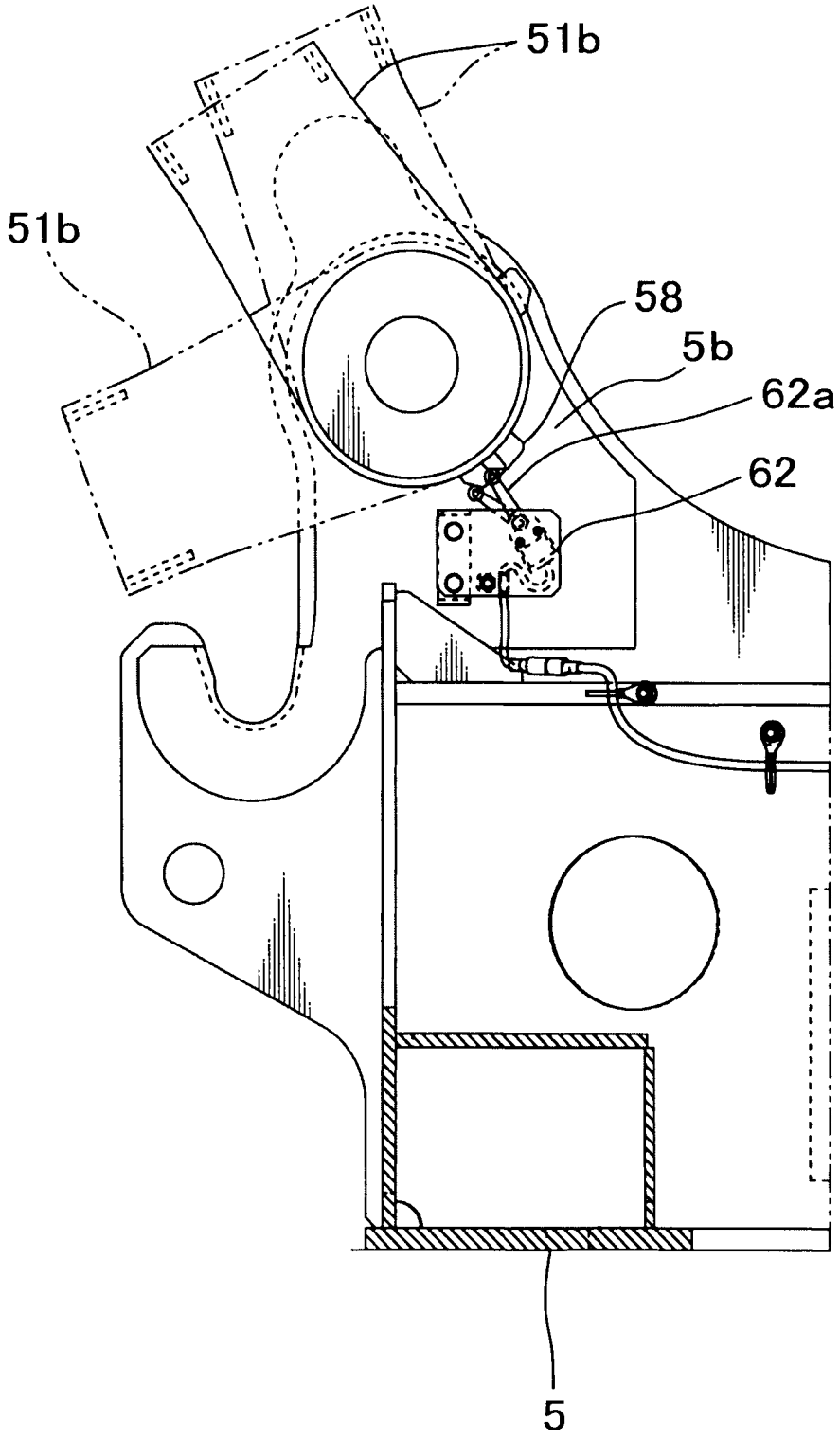
FIG. 12 is a vertical sectional side view illustrating an installation state of a work-posture detector.

As illustrated in FIG. 12, the work posture detector 62 is installed on a gantry mounting portion 5*b* of the frame 5 in opposed relation to a base end of the tension member 51 (specifically, the lower sub-member 51*b* of the tension member 51) of the gantry 11. The work posture detector 62 is adapted, when the posture of the gantry 11 is changed from the storage posture to the work posture, to detect the fact and output a detection signal to the controller 43. Specifically, the work posture detector 62 is adapted, in response to a contact between a contact lever 62*a* of the work posture detector 62 and a protrusion 58 provided on a base end of the tension member 51 of the gantry 11, when the gantry 11 is set in the work posture, to output a detection signal.

In the second embodiment, the controller 43 is operable, when the mast 7 reaches a predetermined raising/lowering angle at which a supporting point for the raising and lowering of the mast 7, and the tip end of the mast 7, are approximately aligned with a point at which the top of the gantry 11 is disposed when the gantry 11 is set in the work posture, to stop the hoisting-up and hoisting-down of the mast 7 by the raising and lowering winch 10. In this state, if the work posture detector 62 does not detect that the gantry 11 is in the work posture, the controller 43 prohibits the hoisting-up of the mast 7 by the raising and lowering winch 10, and, if the work posture detector 62 detects that the gantry 11 is in the work posture, the controller 43 permits the hoisting-up of the mast 7 by the raising and lowering winch 10. The predetermined raising/lowering angle is an angle which is less than the lower limit angle during the suspending work using the mast 7, and at which the mast 7 extends forwardly and obliquely downwardly. Further, the controller 43 is operable, if the work posture detector 62 does not detect that the gantry 11 is in the work posture, at a time when the operating member of the release switch 41 is operated to the ON position, to prohibit the raising and lowering winch 10 from hoisting down the mast 7, and, if the work posture detector 62 detects that the gantry 11 is in the work posture, at a time when the operating member of the release switch 41 is operated to the ON position, to permit the raising and lowering winch 10 to hoist down the mast 7.

The expression "a supporting point for the raising and lowering of the mast 7, and the tip end of the mast 7 are approximately aligned with a point at which the top of the gantry 11 is disposed when the gantry 11 is set in the work posture" is not limited to an arrangement, wherein a supporting point for the raising and lowering of the mast 7, and the tip end of the mast 7 are completely aligned with a point at which the top of the gantry 11 is disposed when the gantry 11 is set in the work posture. The above expression also includes a state that a point at which the top of the gantry 11 is disposed when the gantry 11 is set in the work posture, a supporting point for the raising and lowering of the mast 7, and the tip end of the mast 7 are slightly displaced one from the other with respect to a straight line. Specifically, the above expression means a state that the angle between a vector directing from the tip end of the mast 7 toward a point at which the top of the gantry 11 is disposed when the gantry 11 is set in the work posture, and the vector directing from the tip end of the mast 7 toward a supporting point for the raising and lowering of the mast 7 is in the range of from 0 degree to 3 degrees.

The remaining configuration of the crane according to the second embodiment is the same as that of the crane according to the first embodiment.

Figure 14:
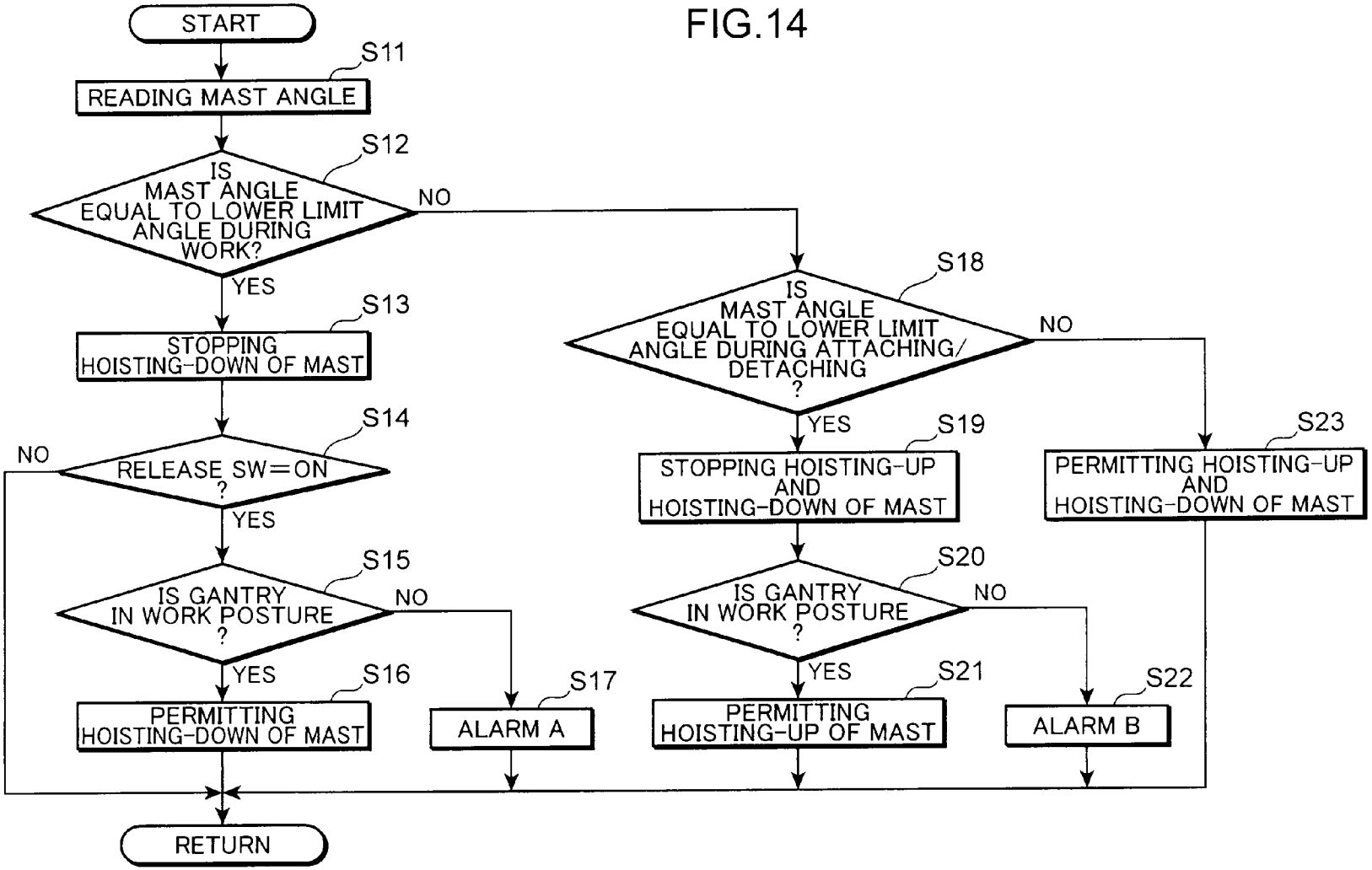
FIG. 14 is a flowchart illustrating details of control to be executed by a controller, in the crawler crane according to the second embodiment.

In the second embodiment, among various controls by the controller 43, a control during a process of hoisting down the mast 7 to a position close to the ground from the state during the suspending work using the mast 7 is performed according to the flowchart illustrated in FIG. 14. Specifically, in FIG. 14, after the control is started, the controller 43 reads a mast angle (i.e., a value of the raising/lowering angle of the mast 7) from a detection signal output from the mast angle detector 48 (Step S11), and determines whether the read mast angle is equal to the lower limit angle (e.g., about 30 degrees) of the mast 7 during the suspending work using the mast 7 (Step S12). When the determination is made as YES, the controller 43 turns off the mast hoisting-down stopping solenoid valve 44*b* to thereby stop the hoisting-down of the mast 7 by the raising and lowering winch 10 (Step S13).

Subsequently, in Step S14, the controller 43 determines whether the release instruction for causing the controller 43 to release the limitation on the raising/lowering angle of the mast 7 during the suspending work using the mast 7 is input into the release switch 41, i.e., the release switch 41 is operated to be turned on. The determination process in Step S14 by the controller 43 is the same as that in Step S4 by the controller 43 in the first embodiment. When the determination in Step S14 is made as NO, the controller 43 directly returns the control flow. On the other hand, when the determination in Step S14 is made as YES, i.e., the controller 43 determines that the operating member of the release switch 41 is operated from the OFF position to the ON position (the release instruction is input into the release switch 41), the controller 43 further determines whether the gantry 11 is in the work posture, based on a signal from the work posture detector 62 (Step S15). When the determination in Step S15 is made as YES, the controller 43 turns on the mast hoisting-down stopping solenoid valve 44*b* to thereby permit the raising and lowering winch 10 to hoist down the mast 7 (Step S16). Then, the controller 43 returns the control flow. On the other hand, when the determination in Step S15 is made as NO, the controller 43 maintains a state in which the hoisting-down of the mast 7 by the raising and lowering winch 10 is prohibited (a state in which the mast hoisting-down stopping solenoid valve 44*b* is turned off), and causes the display unit 45 and the alarm unit 46 to output an alarm A (Step S17). The alarm A is designed to inform an operator about a situation where the hoisting-down of the mast 7 is not permitted because the gantry 11 is not in the work posture although the release switch 41 is operated to be turned on (the release instruction is input into the release switch 41). The controller 43 causes the display unit 45 to display a screen image corresponding to the alarm A, and causes the alarm unit 46 to generate alarm sound corresponding to the alarm A. Then, the controller 43 returns the control flow.

When the determination in Step S12 is made as NO, the controller 43 determines whether the mast angle read in Step 11 is equal to a lower limit angle during the operation of attaching or detaching the guy line or the like to the tip end of the mast 7 (the lower limit angle will hereinafter be referred to as "lower limit angle during attaching/detaching operation") (Step S18). The lower limit angle during attaching/detaching operation is a raising/lowering angle of the mast 7 at which a supporting point P2 for the raising and lowering of the mast 7, and the tip end of the mast 7 (a center point P3 of the upper spreader 24), are approximately aligned with a point (a center point P1 of the lower spreader 25) at which the top of the gantry 11 is disposed when the gantry is set in the work posture, in a state where the mast 7 is hoisted down to a position close to the ground as illustrated in FIG. 11.

Then, when the determination in Step S18 is made as YES, the controller 43 turns off both of the mast hoisting-up stopping solenoid valve 44*a* and the mast hoisting-down stopping solenoid valve 44*b* to thereby stop both of the hoisting-up and hoisting-down of the mast 7 by the raising and lowering winch 10 (Step S19). Subsequently, in Step S20, based on a signal from the work posture detector 62, the controller 43 determines whether the gantry 11 is in the work posture. When the determination in Step S20 is made as YES, the controller 43 turns on the mast hoisting-up stopping solenoid valve 44*a* to thereby permit the raising and lowering winch 10 to hoist up the mast 7 (Step S21). Then, the controller 43 returns the control flow. On the other hand, when the determination in Step S20 is made as NO, the controller 43 maintains a state in which the hoisting-up and hoisting-down of the mast 7 by the raising and lowering winch 10 are prohibited (a state in which both of the solenoid valves 44*a*, 44*b* are turned off), and causes the display unit 45 and the alarm unit 46 to output an alarm B (Step S22). The alarm B is designed to inform an operator about a situation where the hoisting-up of the mast 7 is prohibited because the gantry 11 is not in the work posture. The controller 43 causes the display unit 45 to display a screen image corresponding to the alarm B, and causes the alarm unit 46 to generate alarm sound corresponding to the alarm B. Then, the controller 43 returns the control flow.

When both of the determination in Step S12 and the determination in Step S18 are made as NO, i.e., the raising/lowering angle of the mast 7 is not equal to each of the lower limit angle during the suspending work using the mast 7 and the lower limit angle during attaching/detaching operation, the controller 43 turns on both of the mast hoisting-up stopping solenoid valve 44*a* and the mast hoisting-down stopping solenoid valve 44*b* to thereby permit both of the hoisting-up and hoisting-down of the mast 7 by the raising and lowering winch 10 (Step S23). Subsequently, the controller 43 returns the control flow.

Functions and effects of the safety system 40 in the crane according to the second embodiment will be described below. In the process of hoisting down the mast 7 to a position close to the ground before or after the suspending work using the mast 7 as substitute for a boom, when the raising/lowering angle of the mast 7 becomes equal to the lower limit angle during attaching/detaching operation, i.e., a predetermined angle at which the supporting point P2 for the raising and lowering of the mast 7, and the tip end P3 of the mast 7, are approximately aligned with the point P1 at which the top of the gantry 11 is disposed when the gantry 11 is set in the work posture, both of the mast hoisting-up stopping solenoid valve 44*a* and the mast hoisting-down stopping solenoid valve 44*b* are turned off according to a command from the controller 43, so that both of the hoisting-up and hoisting-down of the mast 7 by the raising and lowering winch 10 are stopped (Step S19 in FIG. 14).

At this timing, if the gantry 11 is set in the raised state, i.e., in the working posture, based on a signal from the work posture detector 62, the controller 43 determines that the gantry 11 is in the working posture. In this case, the controller 43 permits the hoisting-up of the mast 7 by the raising and lowering winch 10 (Step 21 in FIG. 14), so that an operator can perform an operation for the hoisting-up of the mast 7 using the manipulation device for the raising and lowering winch 10 so as to increase the raising/lowering angle of the mast 7. On the other hand, when the gantry 11 is not set in the work posture, but in a posture where it is lowered rearwardly with respect to the work posture, the controller 43 prohibits the hoisting-up of the mast 7 by the raising and lowering winch 10, so that, even if an operator erroneously perform an operation for the hoisting-up of the mast 7, the raising and lowering winch 10 will never hoist up the mast 7. If the mast 7 set at the above predetermined angle is hoisted up under the condition that the gantry 11 is in a posture where it is lowered rearwardly with respect to the work posture, the tension of the raising and lowering rope 26 will be excessive, and the excessive tension will be applied to the mast 7 in an axial (longitudinal) direction thereof. This is likely to cause deformation, such as buckling, in the mast 7. In contrast, in the second embodiment, such hoisting-up of the mast 7 is never performed, so that it becomes possible to prevent the tension of the raising and lowering rope 26 acting on the mast 7 as an axial compressive force from being excessively increased so as to reliably avoid the occurrence of deformation, such as buckling, in the mast 7.

Particularly, in the second embodiment, when the controller 43 determines that the gantry 11 is not in the work posture at a time when the controller 43 stops the hoisting-up and the hoisting-down of the mast 7, the display unit 45 and the alarm unit 46 inform an operator about the above situation according to the command from the controller 43 (Step S22 in FIG. 14). Thus, the operator can readily recognize his/her operational mistake without being thrown into confusion even if the hoisting-up and hoisting-down of the mast 7 are automatically stopped. This makes it possible to enhance operational convenience.

Further, in the process of hoisting down the mast 7 to a position close to the ground before or after the suspending work using the mast 7, the controller 43 permits the hoisting-down of the mast 7 on condition that the release switch 41 is operated to be turned on and the gantry 11 is in the work posture, at a time when the raising/lowering angle of the mast 7 becomes equal to the lower limit angle during the suspending work using the mast 7 (Step S16 in FIG. 14). This makes it possible to more reliably prevent the occurrence of deformation in the mast 7, etc, due to operator's operational mistake. In addition, when the hoisting-down of the mast 7 is not permitted because the gantry 11 is not in the work posture although the release switch 41 is operated to be turned on, the display unit 45 and the alarm unit 46 inform an operator about the above situation according to the command from the controller 43 (Step S17 in FIG. 14). This makes it possible to further enhance operator's operational convenience.

It is understood that the present invention is not limited to the second embodiment, but various changes and modifications will be included in the scope of the present invention. For example, in the second embodiment, the work posture detector 62 for detecting that the gantry 11 is in the work posture is installed on the gantry mounting portion 5*b* of the frame 5 in opposed relation to the base end of the tension member 51 of the gantry 11, wherein the work posture detector 62 is operable, in response to a contact between the contact lever 62*a* and the protrusion 58 provided on the base end of the tension member 51 of the gantry 11, when the posture of the gantry 11 is changed from the storage posture to the work posture, to output a detection signal. However, the work posture detector in the present invention is not limited to such a configuration. For example, the work posture detector may be configured to continuously measure an inclination angle of the tension member 51 or the compression member 52 of the gantry 11, and detect that the gantry 11 is in the work posture, based on the measured inclination angle.

In the second embodiment, in the process of hoisting down the mast 7 to a position close to the ground before or after the suspending work using the mast 7, when the raising/lowering angle of the mast 7 becomes equal to the lower limit angle during attaching/detaching operation, i.e., a predetermined angle at which the supporting point P2 for the mast 7, and the tip end P3 of the mast 7, are approximately aligned with the point P1 at which the top of the gantry 11 is disposed when it is set in the work posture, the control for stopping the hoisting-up and hoisting-down of the mast 7 by the raising and lowering winch 10 is performed. However, it is understood that, with a view to enhancing control accuracy, an inclinometer may be provided in a crane body (the lower propelling body 2 or the upper slewing body 4) to correct angle to ground of the raising/lowering angle of the mast 7 based on a value of the raising/lowering angle of the mast 7 measured by the inclinometer.

[Outline of Embodiments]

The outline of the above embodiments is as follows.

In the embodiments, a crane comprises: an upper slewing body having a frame; a boom having a tip end, and a base end supported by a front end of the frame in such a manner as to be pivotable therearound, the boom being adapted to be raised and lowered according to the pivoting movement of the base end thereof; a mast having a tip end coupled to the tip end of the boom via a guy line, and a base end supported by the front end of the frame in such a manner as to be pivotable therearound, the mast being adapted to be raised and lowered according to the pivoting movement of the base end thereof; an upper spreader provided on the tip end of the mast; a lower spreader disposed rearwardly with respect to a position at which the upper spreader is disposed when the mast is in a raised state; a raising and lowering rope wound around and between the upper spreader and the lower spreader; a raising and lowering winch adapted to wind or unwind the raising and lowering rope to allow the boom and the mast to be tilted so as to be raised or lowered; a mast support device provided on the upper slewing body to push up the mast to change a posture of the mast from a transportation posture where the mast is lowered rearwardly to extend approximately horizontally, to a work posture where the mast extends forwardly and obliquely upwardly; a limiting device adapted, during a suspending work for suspending a load from the tip end of the mast, to limit a raising/lowering angle of the mast to be equal to or less than an upper limit angle which is less than a value of the raising/lowering angle as measured when the mast extends vertically; a release device into which a release instruction for causing the limiting device to release the limitation on the raising/lowering angle of the mast is input; and a first detection section adapted to detect that the mast support device is at an overhanging position where the mast support device pushes up and set the mast in the work posture, wherein the limiting device is operable, whenever the first detection section does not detect that the mast support device is at the overhanging position, even if the release instruction is input into the release device, to prohibit the mast from being tilted rearward beyond the upper limit angle.

In the above crane, in a process of returning the mast from the work posture to the transportation posture after completion of the suspending work using the mast, if, despite the fact that the mast support device is not at the overhanging position, an operator inputs the release instruction into the release device without ascertaining the fact, the limiting device determines that the mast support device is not at the overhanging position, and prohibits the mast from being tilted rearward beyond the upper limit angle. Thus, the mast is never tilted rearward beyond the upper limit angle. This makes it possible to prevent collapse of the mast due to operator's operational mistake, so as to ensure safety. On the other hand, when the mast support device is moved to the overhanging position and then the release instruction is input into the release device, the limiting device determines that the mast support device is at the overhanging position, and permits the mast to be tilted rearward beyond the upper limit angle. In this case, the mast can be tilted to a position where it is inclined rearwardly with respect to the vertical state, while being supported by the mast support device.

Preferably, the above crane further comprises an informing section adapted, if the first detection section does not detect that the mast support device is at the overhanging position at a time when the release instruction is input into the release device, to inform an operator about a situation where the mast support device is not at the overhanging position although the release instruction is input into the release device.

In this crane, if, despite the fact that the mast support device is not at the overhanging position, an operator inputs the release instruction into the release device, the limiting device causes the informing device to inform an operator about the situation by means of display and audio, in addition to prohibiting the rearward tilting movement of the mast as mentioned above. This allows the operator to easily recognize the situation where the mast is not tilted rearward, and become quickly aware of operational mistake.

Preferably, the above crane further comprises: a gantry provided on the frame in such a manner that a posture of the gantry is changeable on a rear portion of the frame between a work posture where the gantry is raised, and a storage posture where the gantry is lowered rearwardly; and a second detection section adapted to detect that the gantry is in the work posture, wherein: the lower spreader is provided on a portion of the gantry which becomes a top of the gantry when the gantry is set in the work posture; and the limiting device is operable, when the mast reaches a predetermined raising/lowering angle at which a supporting point for the raising and lowering of the mast, and the tip end of the mast, are approximately aligned with a point at which the top of the gantry is disposed when the gantry is set in the work posture, to stop hoisting-up and hoisting-down of the mast by the raising and lowering winch, and, if, in this state, the second detection section does not detect that the gantry is in the work posture, to prohibit the hoisting-up of the mast by the raising and lowering winch.

In this crane, in a process of hoisting down the mast to a position close to the ground before or after the suspending work using the mast as substitute for the boom, when the raising/lowering angle of the mast becomes equal to a predetermined angle at which the supporting point for the raising and lowering of the mast, and the tip end of the mast, are approximately aligned with a point at which the top of the gantry is disposed when it is set in the work posture, both of the hoisting-up and hoisting-down of the mast by the raising and lowering winch are stopped. At this timing, if the gantry is set in a raised state, i.e., in the working posture, and the second detection section detects that the gantry is in the working posture, the limiting device permits the hoisting-up of the mast by the raising and lowering winch. In this case, an operator can perform an operation for the hoisting-up of the mast to increase the raising/lowering angle of the mast. On the other hand, when the gantry is not in the work posture, but in a posture where it is lowered rearwardly with respect to the work posture, the limiting device prohibits the hoisting-up of the mast by the raising and lowering winch, so that, even if an operator erroneously perform an operation for the hoisting-up of the mast, the raising and lowering winch will never hoist up the mast. Thus, the hoisting-up of the mast is never performed in a situation where a tension of the raising and lowering rope acting on the mast as an axial compressive force is excessively increased, so that it becomes possible to prevent the occurrence of deformation, such as buckling, in the mast.

Preferably, in this case, the crane further comprises an informing section adapted, if the second detection section does not detect that the gantry is in the work posture, at a time when the limiting device stops the hoisting-up and hoisting-down of the mast by the raising and lowering winch, to inform an operator about a situation where the hoisting-up of the mast is prohibited because the gantry is not in the work posture.

In this crane, if the gantry is not in the work posture at a time when the limiting device stops the hoisting-up and hoisting-down of the mast by the raising and lowering winch, the informing device informs an operator about the situation. Thus, the operator can readily recognize his/her operational mistake without being thrown into confusion even if the hoisting-up and hoisting-down of the mast are automatically stopped.

Preferably, in the crane comprising the second detection section, the limiting device is adapted, during a suspending work for suspending a load from the tip end of the mast, to limit the raising/lowering angle of the mast to be equal to or greater than a predetermined lower limit angle, in addition to limiting the raising/lowering angle of the mast to be equal to or less than the upper limit angle; and the release instruction to be input into the release device is configured to cause the limiting device to release a state in which the raising/lowering angle of the mast is limited to the lower limit angle or more, in addition to the state in which the raising/lowering angle of the mast is limited to the upper limit angle or less, and wherein the limiting device is operable, if the second detection section does not detect that the gantry is in the work posture at a time when the release instruction is input into the release device, to prohibit the hoisting-down of the mast by the raising and lowering winch.

In this crane, in the process of hoisting down the mast to a position close to the ground before or after the suspending work using the mast, if both of the conditions that the release instruction is input into the release device, and the gantry is in the work posture are not satisfied at a time when the raising/lowering angle of the mast becomes equal to the lower limit angle during the suspending work using the mast, the hoisting-down of the mast by the raising and lower winch is prohibited. This makes it possible to more reliably prevent the occurrence of deformation in the mast, etc, due to operator's operational mistake.

As described above, in the crane according to the above embodiments, in a mast storage process of returning the mast from the work posture to the transportation posture after completion of the suspending work using the mast, if an operator erroneously performs the mast storage process without moving the mast support device to the overhanging position, the rearward tilting movement of the mast is prohibited, so that the mast is never tilted rearward beyond the upper limit angle during the suspending work using the mast. This makes it possible to prevent the occurrence of a situation where the mast falls down rearwardly due to operator's operational mistake, and resulting shock causes damages to the mast and other devices, so that safety can be ensured.

Further, if an operator makes an operational mistake during the mast storage process, the operator is informed about the situation by means of display and audio, in addition to inhibition of the rearward tilting movement of the mast, which provides an advantage of being able to allow the operator to become quickly aware of the operational mistake.

In the crane according to the above embodiments, in the process of hoisting down the mast to a position close to the ground before or after the suspending work using the mast, when the raising/lowering angle of the mast becomes equal to a predetermined angle at which the supporting point for the mast 7, and the tip end of the mast, are approximately aligned with a point at which the top of the gantry is disposed when it is set in the work posture, both of the hoisting-up and hoisting-down of the mast by the raising and lowering winch are stopped. In this state, if the gantry is in the work posture, the hoisting-up of the mast by the raising and lowering winch is permitted, whereas, if the gantry is not in the work posture, the hoisting-up of the mast by the raising and lowering winch is prohibited. This makes it possible to reliably prevent the occurrence of deformation in the mast 7, etc, due to operator's operational mistake.

Further, if the gantry is not in the work posture at a time when the hoisting-up and hoisting-down of the mast by the raising and lowering winch is stopped, an operator is informed about the situation, which provides an advantage of being able to allow the operator to readily recognize his/her operational mistake without being thrown into confusion even if the hoisting-up and hoisting-down of the mast are automatically stopped.

In the process of hoisting down the mast to a position close to the ground before or after the suspending work using the mast, if both of the conditions that the release instruction is input into the release device, and the gantry is in the work posture are not satisfied at a time when the raising/lowering angle of the mast becomes equal to the lower limit angle during the suspending work using the mast, the hoisting-down of the mast by the raising and lower winch is prohibited. This makes it possible to more reliably prevent the occurrence of deformation in the mast, etc, due to operator's operational mistake.

This application is based on Japanese Patent application No. 2010-281156 and 2010-282534 filed in Japan Patent Office on Dec. 17, 2010 and Dec. 20, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A crane comprising:

an upper slewing body having a frame;

a boom having a tip end, and a base end supported by a front end of the frame in such a manner as to be pivotable therearound, the boom being adapted to be raised and lowered according to the pivoting of the base end thereof;

a mast having a tip end coupled to the tip end of the boom via a guy line, and a base end supported by the front end of the frame in such a manner as to be pivotable therearound, the mast being adapted to be raised and lowered according to the pivoting movement of the base end thereof;

an upper spreader provided on the tip end of the mast;

a lower spreader disposed rearwardly with respect to a position at which the upper spreader is disposed when the mast is in a raised state;

a raising and lowering rope wound around and between the upper spreader and the lower spreader;

a raising and lowering winch adapted to wind or unwind the raising and lowering rope to allow the boom and the mast to be tilted so as to be raised or lowered;

a mast support device provided on the upper slewing body to push up the mast to change a posture of the mast from a transportation posture where the mast is lowered rearwardly to extend approximately horizontally, to a work posture where the mast extends forwardly and obliquely upwardly;

a limiting device adapted, during a suspending work for suspending a load from the tip end of the mast, to limit a raising/lowering angle of the mast to be equal to or less than a predetermined upper limit angle which is less than a value of the raising/lowering angle as measured when the mast extends vertically;

a release device into which a release instruction for causing the limiting device to release the limitation on the raising/lowering angle of the mast is input, the release device being adapted to output a release signal to the limiting device when the release instruction is input into the release device and adapted not to output the release signal to the limiting device when the release instruction is not input into the release device;

a first detection section adapted to detect whether the mast support device is at an overhanging position where the mast support device pushes up and sets the mast in the work posture; and a mast angle detector adapted to detect the raising/lowering angle of the mast;

wherein the mast support device has a link member, a sliding member and a cylinder, and wherein the link member has one end and an other end, the one end being supported by the front end of the frame in such a manner as to be pivotable therearound, and wherein the sliding member is connected to the other end of the link member and adapted to support a rear surface of the mast in such a manner as to be slidable with respect to the rear surface when the mast support device supports the mast, and wherein the cylinder is installed between the frame and the sliding member and is adapted to extend and retract to pivotally move the link member, and wherein the first detection section is installed on the frame in opposed relation to the one end of the link member and has a lever which contacts a protrusion provided on the one end of the link member when the link member pivots forward beyond a vertical position to reach a specific position corresponding to the overhanging position, the first detection section being adapted to output a detection signal to the limiting device when the link member reaches the specific position so that the protrusion contacts the lever, and the first detection section being adapted not to output the detection signal when the link member is at a position in which the link member pivots rearward from the specific position so that the protrusion is separated from the lever, and wherein the limiting device prohibits the raising and lowering winch from winding the raising and lowering rope so that the mast is not tilted rearward beyond the upper limit angle when the raising/lowering angle detected by the mast angle detector reaches the upper limit angle and the detection signal is not input into the limiting device, or when the release signal is not input into the limiting device, and permits the raising and lowering winch to wind the raising and lowering rope so that the mast is tilted rearward beyond the upper limit angle when the raising/lowering angle detected by the mast angle detector reaches the upper limit angle and the detection signal and the release signal are input into the limiting device.

2. The crane as defined in claim 1, which further comprises an informing section which is an alarm output device adapted to output an alarm to an operator, the alarm denoting a situation where the mast support device is not at the overhanging position although the release instruction is input into the release device, wherein, if the detection signal is not put into the limiting device at a time when the release signal is input into the limiting device, the limiting device causes the alarm output device to output the alarm, and wherein, if the detection signal is input into the limiting device at a time when the release signal is input into the limiting device, the limiting device does not cause the alarm output device to output the alarm.

3. The crane as defined in claim 1, which further comprises:

a gantry provided on the frame in such a manner that a posture of the gantry is changeable on a rear portion of the frame between a work posture where the gantry is raised, and a storage posture where the gantry is lowered rearwardly; and a second detection section adapted to detect that the gantry is in the work posture, wherein:

the lower spreader is provided on a portion of the gantry which becomes a top of the gantry when the gantry is set in the work posture; and the limiting device is operable, when the mast reaches a predetermined raising/lowering angle at which a supporting point for the raising and lowering of the mast, and the tip end of the mast, are approximately aligned with a point at which the top of the gantry is disposed when the gantry is set in the work posture, to stop hoisting-up and hoisting-down of the mast by the raising and lowering winch, and, if, in this state, the second detection section does not detect that the gantry is in the work posture, to prohibit the hoisting-up of the mast by the raising and lowering winch.

4. The crane as defined in claim 3, which further comprises an informing section adapted, if the second detection section does not detect that the gantry is in the work posture, at a time when the limiting device stops the hoisting-up and hoisting-down of the mast by the raising and lowering winch, to inform an operator about a situation where the hoisting-up of the mast is prohibited because the gantry is not in the work posture.

5. The crane as defined in claim 4, wherein:

the limiting device is adapted, during a suspending work for suspending a load from the tip end of the mast, to limit the raising/lowering angle of the mast to be equal to or greater than a predetermined lower limit angle, in addition to limiting the raising/lowering angle of the mast to be equal to or less than the upper limit angle; and the release instruction to be input into the release device is configured to cause the limiting device to release a state in which the raising/lowering angle of the mast is limited to the lower limit angle or more, in addition to the state in which the raising/lowering angle of the mast is limited to the upper limit angle or less, and wherein the limiting device is operable, if the second detection section does not detect that the gantry is in the work posture at a time when the release instruction is input into the release device, to prohibit the hoisting-down of the mast by the raising and lowering winch.

6. The crane as defined in claim 3, wherein:

the limiting device is adapted, during a suspending work for suspending a load from the tip end of the mast, to limit the raising/lowering angle of the mast to be equal to or greater than a predetermined lower limit angle, in addition to limiting the raising/lowering angle of the mast to be equal to or less than the upper limit angle; and the release instruction to be input into the release device is configured to cause the limiting device to release a state in which the raising/lowering angle of the mast is limited to the lower limit angle or more, in addition to the state in which the raising/lowering angle of the mast is limited to the upper limit angle or less, and wherein the limiting device is operable, if the second detection section does not detect that the gantry is in the work posture at a time when the release instruction is input into the release device, to prohibit the hoisting-down of the mast by the raising and lowering winch.

* * * * *